US011322813B2

(12) United States Patent
Hiratsuka et al.

(10) Patent No.: US 11,322,813 B2
(45) Date of Patent: May 3, 2022

(54) BAND PASS FILTER, COMMUNICATION DEVICE, AND RESONATOR

(71) Applicant: Murata Manufacturing Co., Ltd., Kyoto (JP)

(72) Inventors: Toshiro Hiratsuka, Kyoto (JP); Yoshinori Taguchi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 17/209,405

(22) Filed: Mar. 23, 2021

(65) Prior Publication Data

US 2021/0210830 A1 Jul. 8, 2021

Related U.S. Application Data

(63) Continuation of application No. PCT/JP2019/035692, filed on Sep. 11, 2019.

(30) Foreign Application Priority Data

Sep. 28, 2018 (JP) ..... JP2018-184395

(51) Int. Cl.
*H01P 1/203* (2006.01)
*H01P 7/08* (2006.01)

(52) U.S. Cl.
CPC ..... *H01P 1/20363* (2013.01); *H01P 1/20309* (2013.01)

(58) Field of Classification Search
CPC ..... H01P 1/203; H01P 1/20354; H01P 7/08
See application file for complete search history.

(56) References Cited

U.S. PATENT DOCUMENTS 4,578,656 A 3/1986 Lacour et al.
7,724,109 B2 * 5/2010 Knecht ..... H01P 1/20345 333/204

(Continued)

FOREIGN PATENT DOCUMENTS

CN 102856614 A 1/2013
JP S59-121904 U 8/1984

(Continued)

OTHER PUBLICATIONS

Ohira, Masataka et al., A Novel Microstrip Filter Structure Consisting of Transversal Resonator Array and Its Fully Canonical Bandpass Filter Design, 2015 IEEE MTT-S International Microwave Symposium, 2015.

(Continued)

*Primary Examiner* — Dean O Takaoka
(74) *Attorney, Agent, or Firm* — Pearne & Gordon LLP

(57) ABSTRACT

A band pass filter (1) includes two resonators (8) and (10) including respectively linear conductors (9) and (11) disposed inside a dielectric substrate (2), and a pair of input-output lines (13) and (14) to which the two resonators (8) and (10) are connected in parallel. Both ends of the linear conductor (9) of the resonator (8) are left open. The resonator (10) includes vias (12A) and (12B) through which both ends of the linear conductor (11) of the resonator (10) are connected to a ground conductor (6) on a first surface (2A) of the dielectric substrate (2). The pair of input-output lines (13) and (14) include respectively vias (15A) and (15B) for connection to a ground conductor (7) that is disposed on a second surface (2B) of the dielectric substrate (2).

19 Claims, 20 Drawing Sheets

(56) References Cited

U.S. PATENT DOCUMENTS 8,260,242 B2 * 9/2012 Yoshikawa ..... H01P 1/20345
455/307
8,314,667 B2 * 11/2012 Uhm ..... H01P 1/20336
333/204

FOREIGN PATENT DOCUMENTS

JP H08-237003 A 9/1996
JP 2006-311100 A 11/2006

OTHER PUBLICATIONS

Kato, Toshiki et al., A Microstripe Bandpass Filter with Transmission Zeros Provided by Transversal Resonator Array. Proceedings of the 2015 IEICE General Conference, Electronics 1.
International Search Report for PCT/JP2019/035692 dated Oct. 15, 2019.
Written Opinion for PCT/JP2019/035692 dated Oct. 15, 2019.
Chinese Office action for Application No. 201980063186.6 dated Aug. 31, 2021.

* cited by examiner

BAND PASS FILTER, COMMUNICATION DEVICE, AND RESONATOR

CROSS REFERENCE TO RELATED APPLICATION

This is a continuation of International Application No. PCT/JP2019/035692 filed on Sep. 11, 2019 which claims priority from Japanese Patent Application No. 2018-184395 filed on Sep. 28, 2018. The contents of these applications are incorporated herein by reference in their entireties.

FIELD OF THE DISCLOSURE

The present disclosure relates to a band pass filter, a communication device, and a resonator that are suitably used for electromagnetic waves of radio frequencies (called radio frequency signals), such as microwaves and millimeter waves, for example.

DESCRIPTION OF THE RELATED ART

There is known a band pass filter that includes a resonator formed of a linear conductor and that allows a radio frequency signal in a desired band to pass therethrough. A resonator parallel-coupled filter including a plurality of resonators coupled in parallel is disclosed in Non-Patent Document 1. In an example of the resonator parallel-coupled filter, two resonators are connected in parallel between a pair of input-output lines. In such a case, phases of the two resonators need to be reversed to each other. The resonator parallel-coupled filter disclosed in Non-Patent Document 1 includes an odd mode resonator of which both ends are left open and an even mode resonator of which both ends are short-circuited to a ground. The odd mode resonator and the even mode resonator are connected in parallel between the pair of input-output lines.

Non-Patent Document 1: M. Ohira, T. Kato and Z. Ma, "novel microstrip filter structure consisting of transversal resonator array and its fully canonical bandpass filter design", 2015 IEEE MTT-S Int. Microwave Symp. (IMS 2015), Phoenix, Ariz., May 2015.

BRIEF SUMMARY OF THE DISCLOSURE

A narrow band filter with a fractional band width of 5% or less is known as an application example of the resonator parallel-coupled filter. However, the resonator parallel-coupled filter with the fractional band width of 5% or more is not yet realized. The reason is that an external Q and a coupling coefficient of the even mode resonator cannot be set to values required for providing the fractional band width of 5% or more. Such a problem also generates in a resonator series-coupled filter in which the even mode resonators are connected in series.

An object of an embodiment of the present disclosure is to provide a band pass filter, a communication device, and a resonator which can widen the fractional band width.

An embodiment of the present disclosure resides in a band pass filter including a dielectric substrate, ground conductors disposed respectively on a first surface and a second surface of the dielectric substrate, a first resonator including a linear conductor disposed inside the dielectric substrate, a second resonator including a linear conductor disposed inside the dielectric substrate, and a first input-output line and a second input-output line which connect the first resonator and the second resonator to external circuits and to which the first resonator and the second resonator are connected in parallel, wherein both ends of the linear conductor of the first resonator are left open, the second resonator includes a pair of first vias respectively through which both ends of the linear conductor of the second resonator are connected to the ground conductor on one of the first surface and the second surface of the dielectric substrate, the first input-output line includes one second via for connection to the ground conductor that is disposed on the other of the first surface and the second surface of the dielectric substrate and that is different from the ground conductor for connection through the first vias, and the second input-output line includes the other second via for connection to the ground conductor that is disposed on the other of the first surface and the second surface of the dielectric substrate and that is different from the ground conductor for connection through the first vias.

Another embodiment of the present disclosure resides in a band pass filter including a dielectric substrate, ground conductors disposed respectively on a first surface and a second surface of the dielectric substrate, a first resonator including a linear conductor disposed inside the dielectric substrate, and a second resonator including a linear conductor disposed inside the dielectric substrate, the second resonator being coupled to the first resonator, wherein the first resonator includes a pair of first-surface side vias respectively through which both ends of the linear conductor of the first resonator are connected to the ground conductor that is disposed on the first surface of the dielectric substrate, and the second resonator includes a pair of second-surface side vias respectively through which both ends of the linear conductor of the second resonator are connected to the ground conductor that is disposed on the second surface of the dielectric substrate.

A still another embodiment of the present disclosure resides in a band pass filter including a dielectric substrate, ground conductors disposed respectively on a first surface and a second surface of the dielectric substrate, a first resonator including a linear conductor disposed inside the dielectric substrate, and a second resonator including a linear conductor disposed inside the dielectric substrate, the second resonator being coupled to the first resonator, wherein the first resonator includes one first-surface side via through which a first end of the linear conductor of the first resonator is connected to the ground conductor that is disposed on the first surface of the dielectric substrate, and one second-surface side via through which a second end of the linear conductor of the first resonator is connected to the ground conductor that is disposed on the second surface of the dielectric substrate, and the second resonator includes the other second-surface side via through which a first end of the linear conductor of the second resonator is connected to the ground conductor that is disposed on the second surface of the dielectric substrate, and the other first-surface side via through which a second end of the linear conductor of the second resonator is connected to the ground conductor that is disposed on the first surface of the dielectric substrate.

According to the present disclosure, a fractional band width of the band pass filter can be widened.

DETAILED DESCRIPTION OF THE DISCLOSURE

Figure 1:
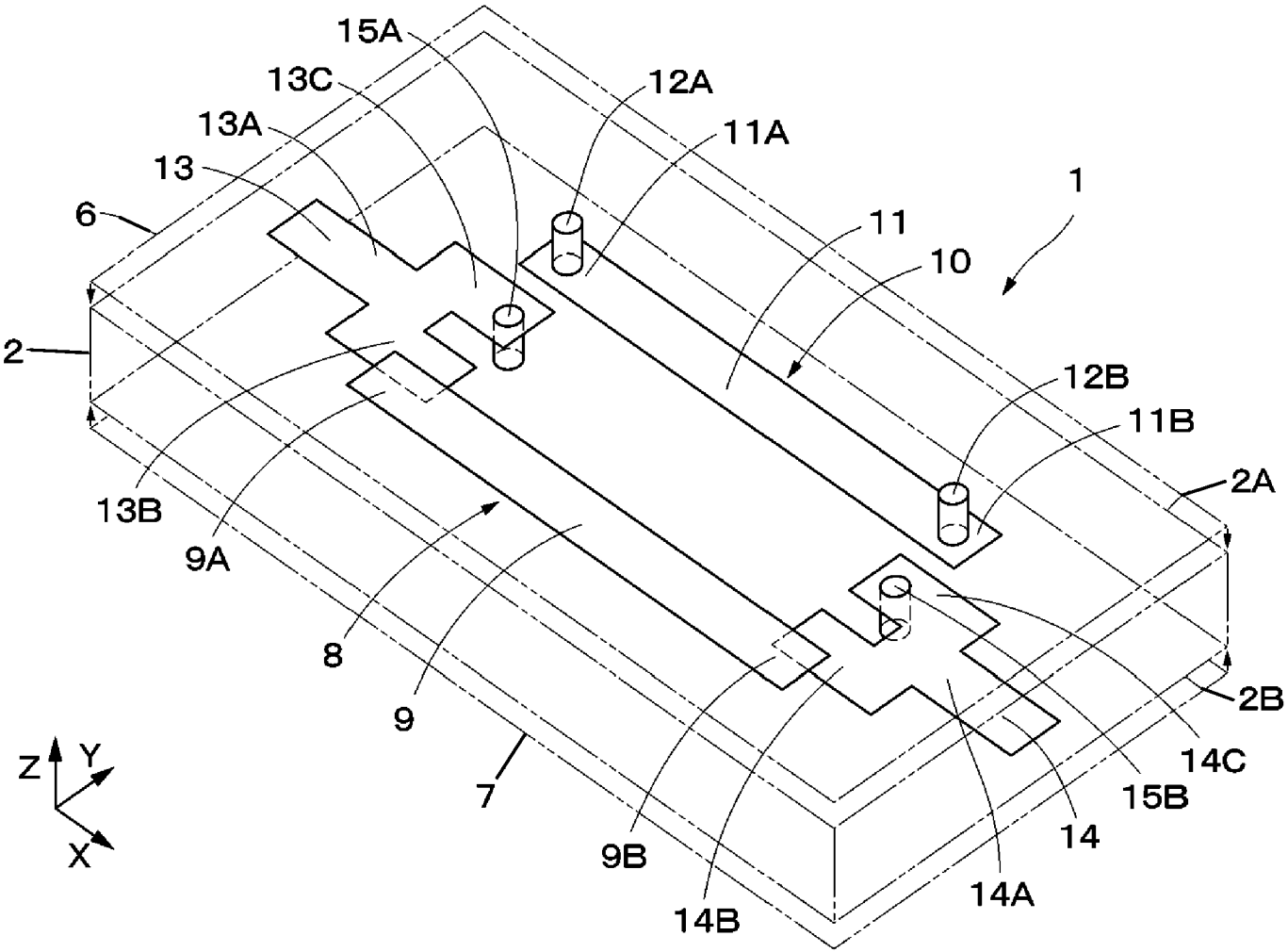
FIG. 1 is a perspective view of a band pass filter according to a first embodiment of the present disclosure.

A band pass filter, a communication device, and a resonator according to embodiments of the present disclosure will be described in detail below with reference to the accompanying drawings.

FIGS. 1 to 4 illustrate a band pass filter 1 according to a first embodiment of the present disclosure. The band pass filter 1 includes a dielectric substrate 2, ground conductors 6 and 7, resonators 8 and 10, and input-output lines 13 and 14.

The dielectric substrate 2 is in the form of a flat plate extending parallel to two directions among an X-axis direction, a Y-axis direction, and a Z-axis direction orthogonal to one another, for example, the X-axis direction and the Y-axis direction. The dielectric substrate 2 is formed as, for example, a low temperature co-fired ceramic multilayer substrate (LTCC multilayer substrate). The dielectric substrate 2 includes three insulating layers 3 to 5 (see FIGS. 3 and 4) that are laminated in the Z-axis direction to range from a first surface 2A serving as a first principal surface toward a second surface 2B serving as a second principal surface. Each of the insulating layers 3 to 5 is made of an insulating ceramic material capable of being fired at low temperature of 1000° C. or below and is in the form of a thin layer.

The dielectric substrate 2 is not limited to the LTCC multilayer substrate, and it may be a multilayer substrate that is formed by laminating insulating layers made of resin materials, for example. The dielectric substrate 2 may be a multilayer resin substrate that is formed by laminating a plurality of resin layers made of a Liquid Crystal Polymer (LCP) with a lower dielectric constant. The dielectric substrate 2 may be a multilayer resin substrate that is formed by laminating a plurality of resin layers made of a fluorine resin. The dielectric substrate 2 may be a ceramic multilayer substrate other than the LTCC multilayer substrate. Moreover, the dielectric substrate 2 may be a flexible substrate with flexibility, or a rigid substrate with thermal plasticity.

The ground conductors 6 and 7 are made of a conductive metal material such as copper or silver, for example. The ground conductors 6 and 7 may be made of a metal material containing, as a main component, aluminum, gold, or an alloy of such a metal. The ground conductor 6 is disposed on the first surface 2A of the dielectric substrate 2. The ground conductor 7 is disposed on the second surface 2B of the dielectric substrate 2. The ground conductors 6 and 7 are connected to an external ground. Each of the ground conductors 6 and 7 entirely cover the first surface 2A and the second surface 2B of the dielectric substrate 2.

Figure 2:
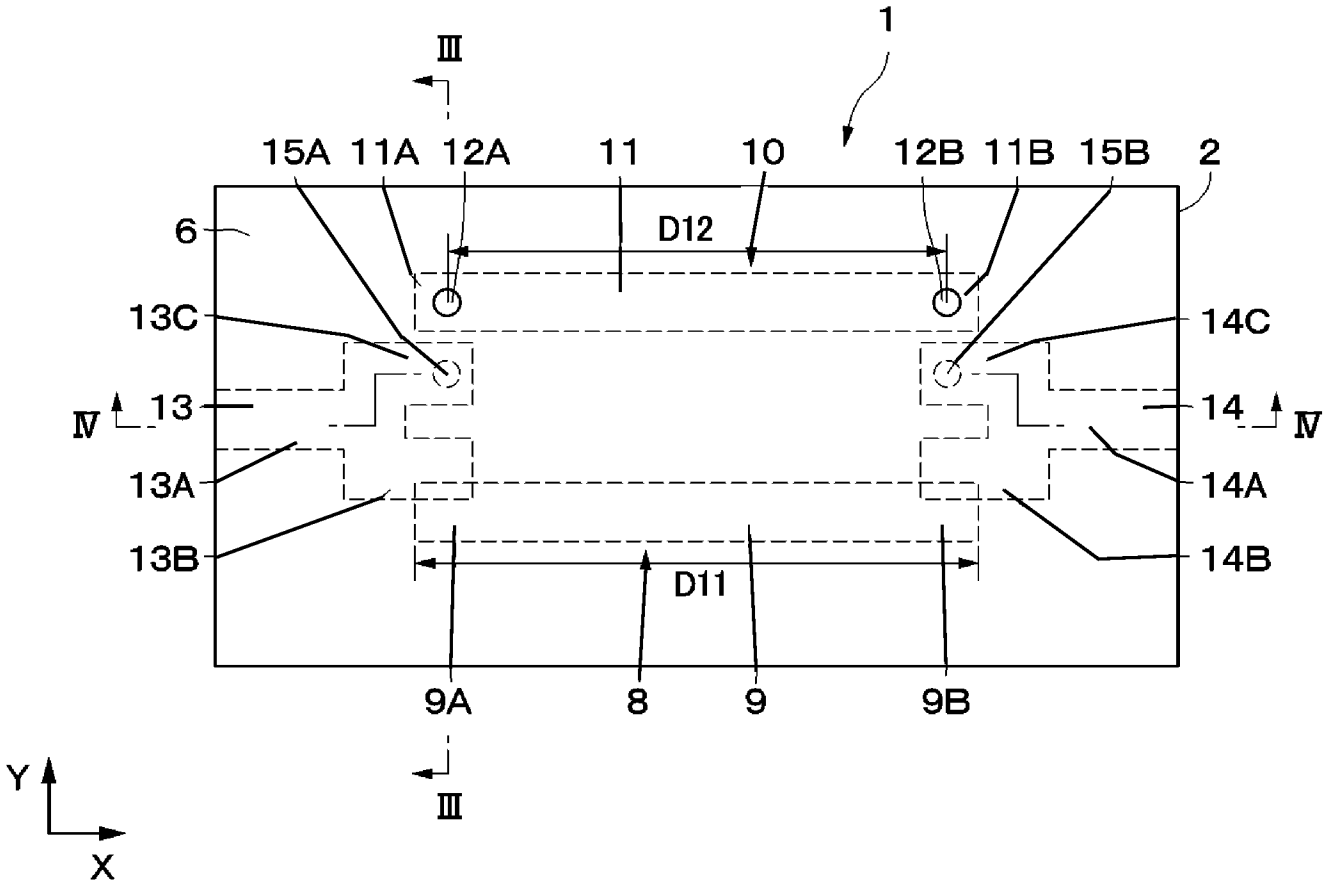
FIG. 2 is a plan view of the band pass filter illustrated in FIG. 1.
Figure 3:
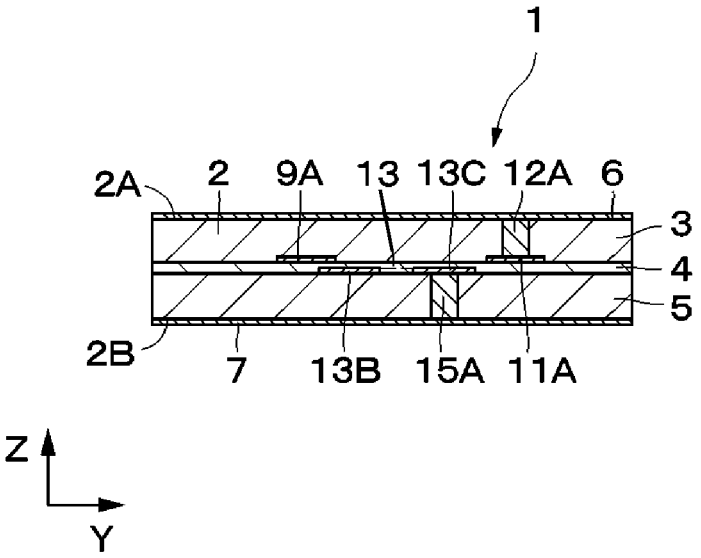
FIG. 3 is a sectional view of the band pass filter taken along III-III in FIG. 2 and viewed in a direction denoted by the arrow.
Figure 4:
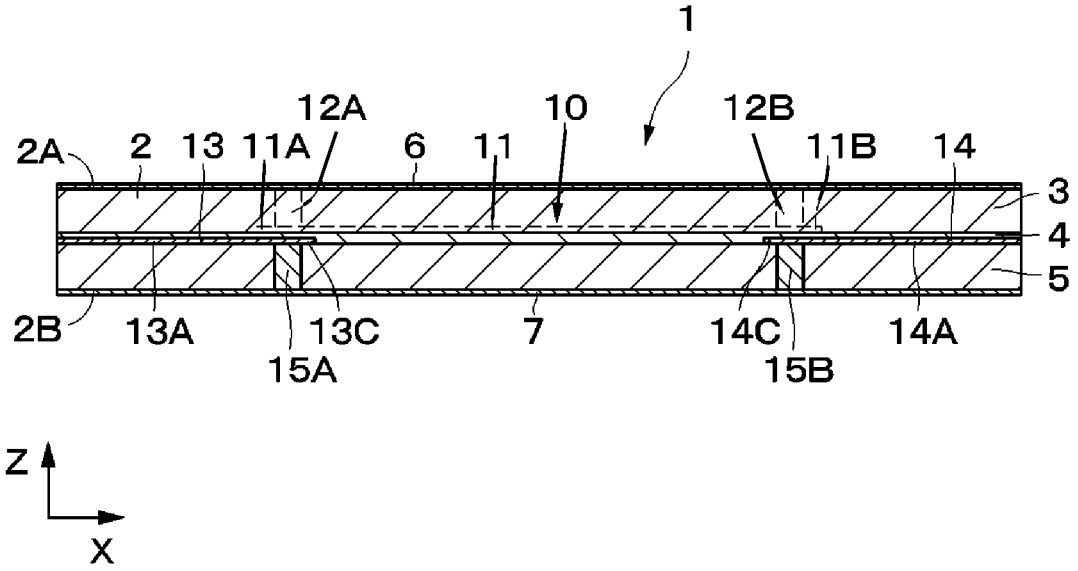
FIG. 4 is a sectional view of the band pass filter taken along IV-IV in FIG. 2 and viewed in a direction denoted by the arrow.

The resonator 8 is disposed inside the dielectric substrate 2 (see FIGS. 1 to 4). The resonator 8 is a first resonator. The resonator 8 includes a linear conductor 9. The linear conductor 9 is positioned between the insulating layer 3 and the insulating layer 4 and is formed in an elongate strip shape extending in the X-axis direction that is a lengthwise direction. As illustrated in FIG. 2, a length D11 of the linear conductor 9 in the X-axis direction is set to ½ of a wavelength in the dielectric substrate 2 corresponding to a first resonant frequency, for example. A first end 9A of the linear conductor 9 is positioned on a first end side in the X-axis direction and is covered with the insulating layers 3 and 4. A second end 9B of the linear conductor 9 is positioned on a second end side in the X-axis direction and is covered with the insulating layers 3 and 4. The first end 9A and the second end 9B of the linear conductor 9 are left open. Accordingly, the resonator 8 constitutes a half-wavelength resonator and also an odd mode resonator.

The term "odd mode resonator" implies a resonator in which both ends are left open, a length of the resonator is ½ of a wavelength determined depending on a resonant frequency, a voltage is 0 at a center, and polarities are different between an input end and an output end. The term "even mode resonator" implies a resonator in which both ends are short-circuited, a length of the resonator is ½ of a wavelength determined depending on a resonant frequency, and a voltage is 0 at both the ends and is maximal or minimal at a center.

The resonator 10 is disposed inside the dielectric substrate 2 (see FIGS. 1 to 4). The resonator 10 is a second resonator. The resonator 10 includes a linear conductor 11. The linear conductor 11 is positioned between the insulating layer 3 and the insulating layer 4 and is formed in an elongate strip shape extending in the X-axis direction that is the lengthwise direction. The linear conductor 11 is spaced from the linear conductor 9 in the Y-axis direction. The linear conductor 11 extends in the X-axis direction parallel to the linear conductor 9.

As illustrated in FIG. 2, a length D12 of the linear conductor 11 in the X-axis direction is set to ½ of a wavelength in the dielectric substrate 2 corresponding to a second resonant frequency, for example. The length D12 is a length from a center of a via 12A to a center of a via 12B. Instead, a size resulting from adding heights of the vias 12A and 12B to the length D12 may be set to ½ of the wavelength in the dielectric substrate 2 corresponding to the second resonant frequency. The length D12 of the linear conductor 11 may be equal to or different from the length D11 of the linear conductor 9.

Figure 11:
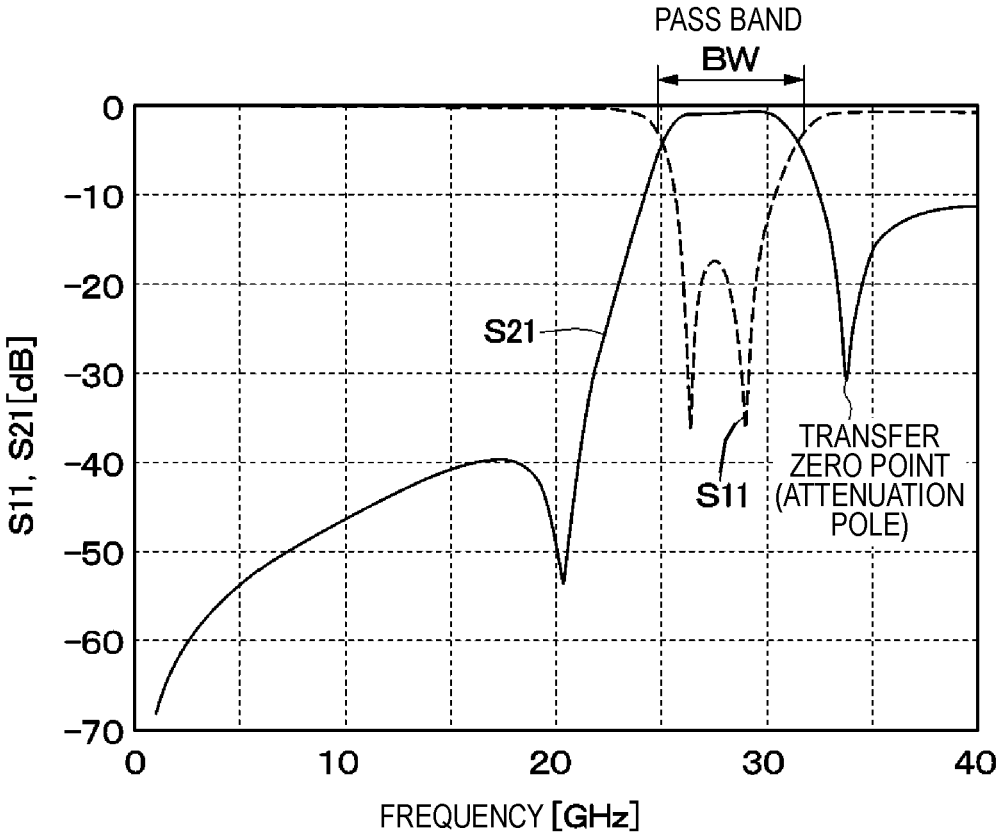
FIG. 11 illustrates characteristic curves representing frequency characteristics of a transmittance coefficient and a reflection coefficient in the band pass filter according to the first embodiment.

When the length D12 of the linear conductor 11 is shorter than the length D11 of the linear conductor 9, the resonant frequency of the odd mode resonator is lower than that of the even mode resonator. In this case, as illustrated in FIG. 11, a frequency at a transfer zero point (attenuation pole) is higher than a pass band.

On the other hand, when the length D12 of the linear conductor 11 is longer than the length D11 of the linear conductor 9, the resonant frequency of the odd mode resonator is higher than that of the even mode resonator. In this case, the frequency at the transfer zero point (attenuation pole) is lower than the pass band.

A first end 11A of the linear conductor 11 is positioned on the first end side in the X-axis direction and is connected to the ground conductor 6 on the first surface 2A of the dielectric substrate 2 through the via 12A that serves as one first via. A second end 11B of the linear conductor 11 is positioned on the second end side in the X-axis direction and is connected to the ground conductor 6 on the first surface 2A of the dielectric substrate 2 through the via 12B that serves as the other first via. The vias 12A and 12B are each formed by a columnar conductor that extends in a thickness direction of the dielectric substrate 2 (namely, in the Z-axis direction) while penetrating through the insulating layer 3. The first end 11A and the second end 11B of the linear conductor 11 are short-circuited to the ground conductor 6. Accordingly, the resonator 10 constitutes a half-wavelength resonator and also an even mode resonator.

The pair of input-output lines 13 and 14 connect the two resonators 8 and 10 to external circuits, and the two resonators 8 and 10 are connected in parallel between the pair of input-output lines 13 and 14 (see FIGS. 1 and 2). The input-output line 13 is a first input-output line. The input-output line 13 is positioned on the first end side in the X-axis direction and is arranged between the insulating layer 4 and the insulating layer 5. The input-output line 14 is a second input-output line. The input-output line 14 is positioned on the second end side in the X-axis direction and is arranged between the insulating layer 4 and the insulating layer 5.

The input-output line 13 is arranged at a position closer to the first ends 9A and 11A of the linear conductors 9 and 11 of the two resonators 8 and 10 than the second ends 9B and 11B thereof. The input-output line 13 includes a transfer line portion 13A, a first coupling portion 13B, and a second coupling portion 13C. The transfer line portion 13A is formed in an elongate strip shape extending in the X-axis direction. The first coupling portion 13B is branched from the transfer line portion 13A, extends toward the resonator 8, and is opposed to the first end 9A of the linear conductor 9 in the thickness direction with the insulating layer 4 interposed therebetween. The first coupling portion 13B is coupled to the first end 9A of the linear conductor 9. In the above-described configuration, the coupling between the first coupling portion 13B of the input-output line 13 and the first end 9A of the linear conductor 9 is mainly capacitive coupling.

The second coupling portion 13C is branched from the transfer line portion 13A, extends toward the resonator 10, and is arranged at a position closer to the first end 11A of the linear conductors 11 than the first end 9A of the linear conductor 9. The second coupling portion 13C is connected to the ground conductor 7 on the second surface 2B of the dielectric substrate 2 through a via 15A that serves as one second via. The via 15A is formed by a columnar conductor that extends in the thickness direction of the dielectric substrate 2 (namely, in the Z-axis direction) while penetrating through the insulating layer 5. The via 15A for the input-output line 13 is arranged at a position near the via 12A for the resonator 10, but different from the position of the via 12A in the Y-axis direction. The via 15A for the input-output line 13 and the via 12A for the resonator 10 extend in opposite directions with respect to the thickness direction of the dielectric substrate 2 (namely, in the Z-axis direction) (see FIGS. 1, 3 and 4). The second coupling portion 13C is coupled to the first end 11A of the linear conductor 11. In the above-described configuration, the coupling between the second coupling portion 13C of the input-output line 13 and the first end 11A of the linear conductor 11 is mainly magnetic field coupling.

The input-output line 14 is arranged at a position closer to the second ends 9B and 11B of the linear conductors 9 and 11 of the two resonators 8 and 10 than the first ends 9A and 11A. The input-output line 14 includes, as in the input-output line 13, a transfer line portion 14A, a first coupling portion 14B, and a second coupling portion 14C. The transfer line portion 14A is formed in an elongate strip shape extending in the X-axis direction. The first coupling portion 14B is branched from the transfer line portion 14A, extends toward the resonator 8, and is opposed to the second end 9B of the linear conductor 9 in the thickness direction with the insulating layer 4 interposed therebetween. The first coupling portion 14B is coupled to the second end 9B of the linear conductor 9. In the above-described configuration, the coupling between the first coupling portion 14B of the input-output line 14 and the second end 9B of the linear conductor 9 is mainly capacitive coupling.

The second coupling portion 14C is branched from the transfer line portion 14A, extends toward the resonator 10, and is arranged at a position closer to the second end 11B of the linear conductors 11 than the second end 9B of the linear conductor 9. The second coupling portion 14C is connected to the ground conductor 7 on the second surface 2B of the dielectric substrate 2 through a via 15B that serves as the other second via. The via 15B is formed by a columnar conductor that extends in the thickness direction of the dielectric substrate 2 (namely, in the Z-axis direction) while penetrating through the insulating layer 5. The via 15B for the input-output line 14 is arranged at a position near the via 12B for the resonator 10, but different from the position of the via 12B in the Y-axis direction. The via 15B for the input-output line 14 and the via 12B for the resonator 10 extend in the opposite directions with respect to the thickness direction of the dielectric substrate 2 (namely, in the Z-axis direction) (see FIGS. 1 and 4). The second coupling portion 14C is coupled to the second end 11B of the linear conductor 11. In the above-described configuration, the coupling between the second coupling portion 14C of the input-output line 14 and the second end 11B of the linear conductor 11 is mainly magnetic field coupling.

The relations of the vias 12A and 12B for the resonator 10 and the vias 15A and 15B for the input-output lines 13 and 14 to an external Q will be described below with reference to FIGS. 5 to 8.

When the input-output lines 13 and 14 and the resonator 10 that is constituted as the even mode resonator are coupled to each other mainly with the magnetic field coupling, the external Q is apt to increase in such a configuration. Hence a fractional band width of the band pass filter tends to narrow.

Figure 5:
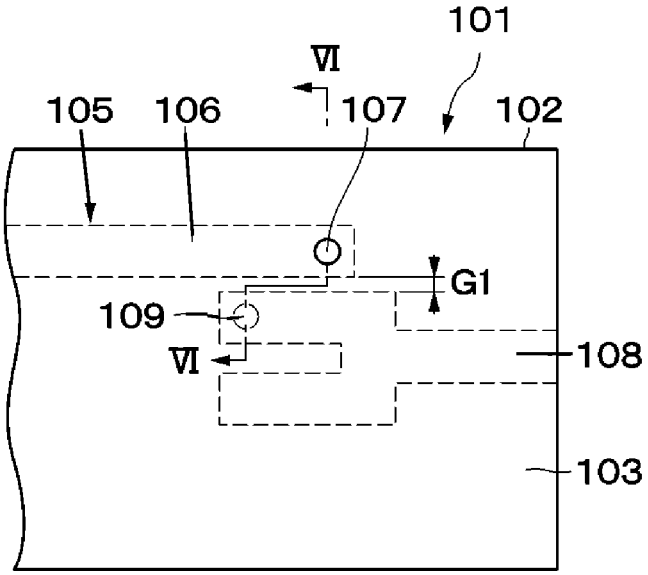
FIG. 5 is a plan view of a calculation model when a via for a resonator and a via for an input-output line extend in opposite directions.
Figure 6:
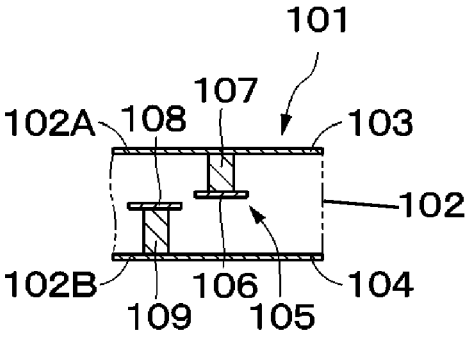
FIG. 6 is a sectional view of the calculation model taken along VI-VI in FIG. 5 and viewed in a direction denoted by the arrow.
Figure 7:
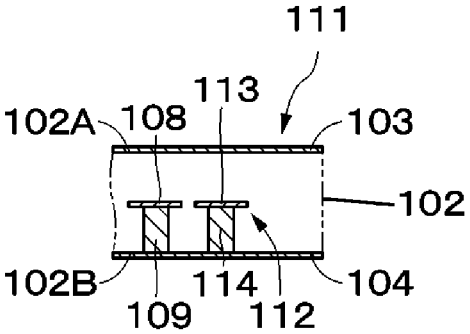
FIG. 7 is a sectional view, taken and viewed in the same way as in FIG. 6, of the calculation model when the via for the resonator and the via for the input-output line extend in the same direction.

As a result of conducting intensive studies, however, the inventor of this application has found that the external Q can be reduced by connecting the vias 12A and 12B for the resonator 10 and the vias 15A and 15B for the input-output lines 13 and 14 to the different ground conductors 6 and 7, respectively. In order to confirm the above-mentioned effect, the external Q is calculated for each of a calculation model 101 including vias in opposite directions as illustrated in FIGS. 5 and 6, and a calculation model 111 including vias in the same direction as illustrated in FIG. 7.

Here, the calculation model 101 includes a dielectric substrate 102, ground conductors 103 and 104, a resonator 105, and an input-output line 108. The ground conductor 103 is disposed on a first surface 102A of the dielectric substrate 102. The ground conductor 104 is disposed on a second surface 102B of the dielectric substrate 102. The resonator 105 is an even mode resonator and includes a linear conductor 106 disposed inside the dielectric substrate 102. Both ends (only one of which is illustrated) of the linear conductor 106 are connected to the ground conductor 103 through a via 107. The input-output line 108 is positioned near the via 107 and is disposed inside the dielectric substrate 102. The input-output line 108 is connected to the ground conductor 104 through a via 109. Thus, in the calculation model 101, the via 107 for the resonator 105 and the via 109 for the input-output line 108 extend in opposite directions (in staggered layout) with respect to a thickness direction of the dielectric substrate 102, and hence constitute the vias in the opposite directions.

The calculation model 111 includes, almost as in the calculation model 101, the dielectric substrate 102, the ground conductors 103 and 104, a resonator 112, and the input-output line 108. Like the resonator 105 in the calculation model 101, the resonator 112 is an even mode resonator and includes a linear conductor 113 disposed inside the dielectric substrate 102. However, both ends (only one of which is illustrated) of the linear conductor 113 are connected to the ground conductor 104 through a via 114. Thus, in the calculation model 111, the via 114 for the resonator 112 and the via 109 for the input-output line 108 extend in the same direction with respect to the thickness direction of the dielectric substrate 102, and hence constitute the vias in the same direction.

Figure 8:
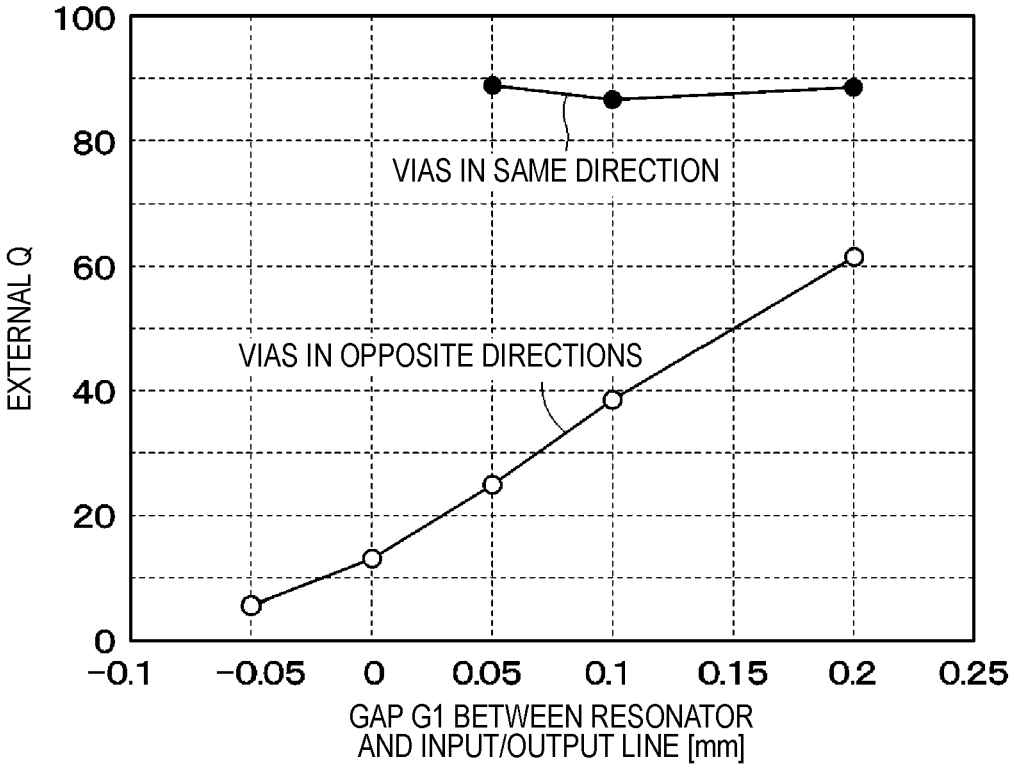
FIG. 8 illustrates characteristic curves representing the relation of a gap between the resonator and the input-output line to an external Q.

The relation of a gap G1 between each of the linear conductors 106 and 113 of the resonators 105 and 112 and the input-output line 108 to the external Q is determined for each of the above-described calculation models 101 and 111. FIG. 8 illustrates the determined results.

Figure 9:
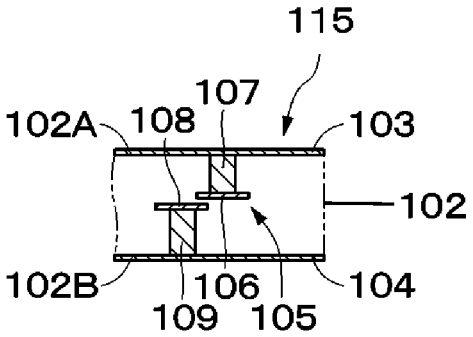
FIG. 9 is a sectional view, taken and viewed in the same way as in FIG. 6, of a calculation model according to a first modification.

As illustrated in FIG. 8, in the calculation model 111 including the vias in the same direction, the external Q does not change substantially and is 80 or more, for example, even when the gap G1 is changed. In contrast, in the calculation model 101 including the vias in the opposite directions, it is seen that the external Q decreases as the gap G1 decreases. Particularly, when the gap G1 takes a negative value, the external Q decreases below 10. When the gap G1 takes a negative value, the linear conductor 106 and the input-output line 108 overlap with each other as in a calculation model 115 according to a first modification illustrated in FIG. 9. Accordingly, the fractional band width of the band pass filter can be widened in the calculation model 101.

Figure 10:
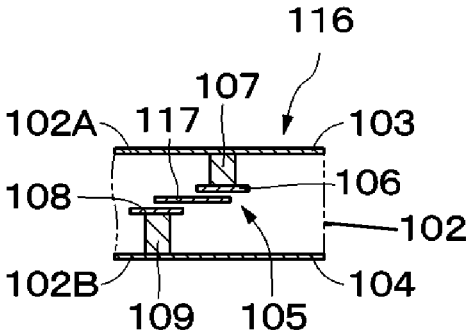
FIG. 10 is a sectional view, taken and viewed in the same way as in FIG. 6, of a calculation model according to a second modification.

The linear conductor 106 and the input-output line 108 are not always required to directly overlap with each other. For example, like a calculation model 116 according to a second modification illustrated in FIG. 10, the linear conductor 106 and the input-output line 108 may indirectly overlap with each other with an intermediate conductor 117, namely another conductor, interposed therebetween. In that case, the intermediate conductor 117 is positioned between the linear conductor 106 and the input-output line 108 with respect to the thickness direction of the dielectric substrate 102. The intermediate conductor 117 overlaps with not only the linear conductor 106, but also the input-output line 108. The intermediate conductor 117 is a conductor with a length shorter than ½ of a wavelength corresponding to a resonant frequency or a stop band frequency of the resonator. In other words, the intermediate conductor 117 is a non-resonant electrode and does not resonate in the frequencies of a pass band and the stop band required for the filter.

In the band pass filter 1 according to the first embodiment, as in the calculation model 101, the vias 12A and 12B for the resonator 10 and the vias 15A and 15B for the input-output lines 13 and 14 extend in the opposite directions with respect to the thickness direction of the dielectric substrate 2. Therefore, the fractional band width of the band pass filter can be widened in the band pass filter 1 according to the first embodiment as well.

In order to confirm frequency characteristics of the band pass filter 1 according to the first embodiment, the frequency characteristics of the S parameters, namely S11 (reflection coefficient) and S21 (transmittance coefficient), are determined. FIG. 11 illustrates an example of the determined results.

In the band pass filter 1 according to this embodiment, as illustrated in FIG. 11, the reflection coefficient S11 increases toward a minus direction from 0 dB and the transmittance coefficient S21 comes close to 0 dB near a range of 25 to 31 GHz, namely a pass band. Thus, it is confirmed that the band pass filter 1 can operate as a band pass filter having a bandpass characteristic with the fractional band width of 15% or more, for example. Here, the fractional band width is a value resulting from dividing a center frequency of 28 GHz by a band width BW illustrated in FIG. 11.

As described above, the band pass filter 1 according to the first embodiment includes the dielectric substrate 2, the ground conductors 6 and 7 disposed respectively on the first surface 2A and the second surface 2B of the dielectric substrate 2, the resonator 8 including the linear conductor 9 disposed inside the dielectric substrate 2, the resonator 10 including the linear conductor 11 disposed inside the dielectric substrate 2, and the input-output line 13 and the input-output line 14 which connect the resonator 8 and the resonator 10 to the external circuits and to which the resonator 8 and the resonator 10 are connected in parallel.

In addition, both the ends of the linear conductor 9 of the resonator 8 are left open, the resonator 10 includes the pair of vias 12A and 12B respectively through which both the ends of the linear conductor 11 of the resonator 10 are connected to the ground conductor 6 on one of the first surface 2A and the second surface 2B of the dielectric substrate 2, the input-output line 13 includes the via 15A for connection to the ground conductor 7 that is disposed on the other of the first surface 2A and the second surface 2B of the dielectric substrate 2 and that is different from the ground conductor 6 for connection through the vias 12A and 12B, and the input-output line 14 includes the via 15B for connection to the ground conductor 7 that is disposed on the other of the first surface 2A and the second surface 2B of the dielectric substrate 2 and that is different from the ground conductor 6 for connection through the vias 12A and 12B.

With the above-described configuration, the resonator 8 operates as an odd mode resonator of which both ends are left open, and the resonator 10 operates as an even mode resonator of which both ends are connected to the ground conductor 6. The odd mode resonator and the even mode resonator are connected in parallel between the input-output line 13 and the input-output line 14, thus constituting a resonator parallel-coupled filter. Furthermore, the vias 12A and 12B for the even mode resonator (the resonator 10) and the vias 15A and 15B for the input-output lines 13 and 14 extend in the opposite directions (in staggered layout) with respect to the thickness direction of the dielectric substrate 2 and are connected to the different ground conductors 6 and 7, respectively. As a result, the external Q of the resonator 10 is reduced and the fractional band width of the band pass filter 1 can be widened in comparison with the case in which the vias 12A and 12B for the resonator 10 and the vias 15A and 15B for the input-output lines 13 and 14 are connected to the same ground conductor.

Figure 12:
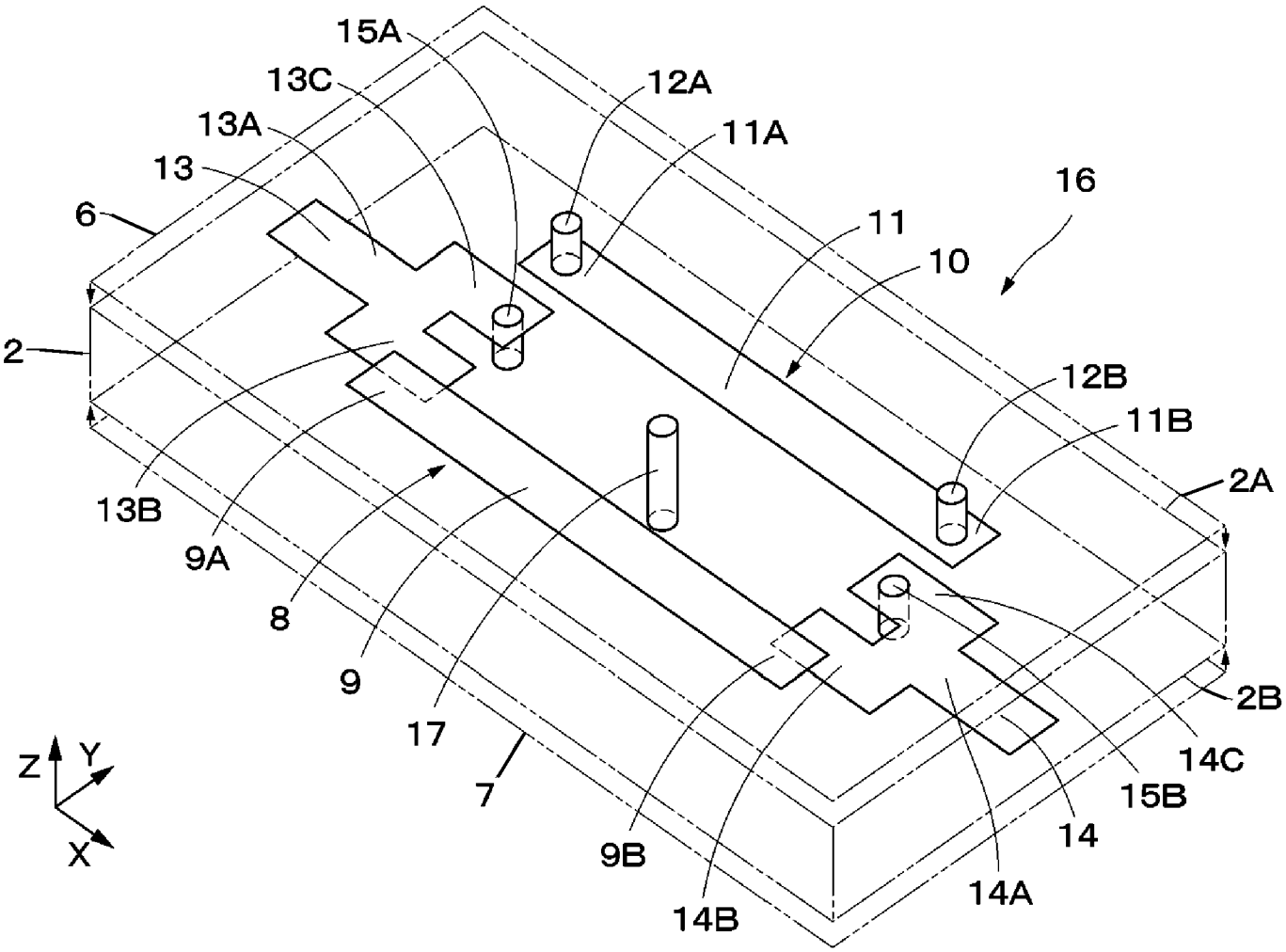
FIG. 12 is a perspective view of a band pass filter according to a second embodiment of the present disclosure.
Figure 13:
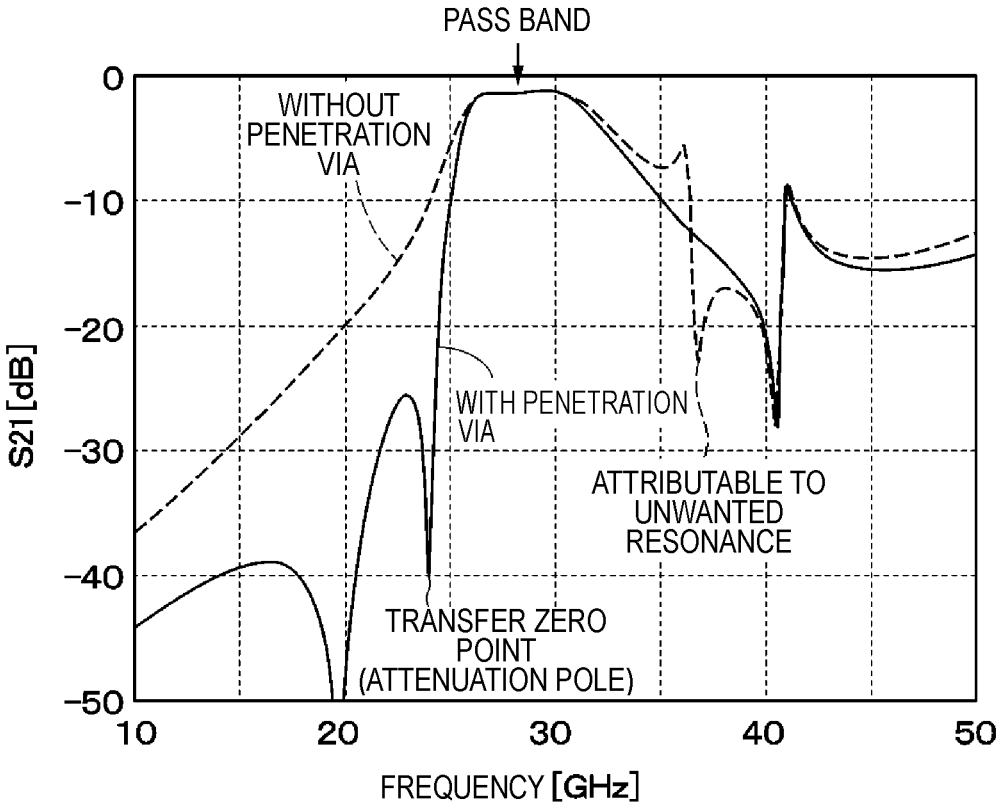
FIG. 13 illustrates characteristic curves representing frequency characteristics of the transmittance coefficient in the band pass filter according to the second embodiment.

A second embodiment of the present disclosure will be described below with reference to FIGS. 12 and 13. The second embodiment is featured in including a penetration via that is positioned between the two resonators, that penetrates through the dielectric substrate in the thickness direction, and that connects the ground conductor on the first surface of the dielectric substrate and the ground conductor on the second surface of the dielectric substrate to each other. In the second embodiment, the same constituent elements as those in the first embodiment are denoted by the same reference signs, and the description of those constituent elements is omitted.

A band pass filter 16 according to the second embodiment includes, almost as in the band pass filter 1 according to the first embodiment, the dielectric substrate 2, the ground conductors 6 and 7, the resonators 8 and 10, and the input-output lines 13 and 14. In addition, the band pass filter 16 includes a penetration via 17.

The penetration via 17 is positioned between the two resonators 8 and 10, penetrates through the dielectric substrate 2 in the thickness direction, and connects the ground conductor 6 on the first surface 2A of the dielectric substrate 2 and the ground conductor 7 on the second surface 2B of the dielectric substrate 2 to each other. The penetration via 17 is arranged, for example, near a middle position between the resonator 8 and the resonator 10 with respect to the Y-axis direction.

In the second embodiment with the above-described configuration as well, the external Q of the resonator 10 is reduced and the fractional band width of the band pass filter 16 can be widened.

When the penetration via 17 is omitted, unwanted resonance attributable to a cavity may generate in some cases. This causes a problem that, as denoted by the dashed line in FIG. 13, an attenuation pole is not produced in a demanded frequency range (for example, on a lower frequency side of the pass band). On the other hand, the band pass filter 16 includes the penetration via 17 that is positioned between the two resonators 8 and 10, that penetrates through the dielectric substrate 2 in the thickness direction, and that connects the ground conductor 6 on the first surface 2A of the dielectric substrate 2 and the ground conductor 7 on the second surface 2B of the dielectric substrate 2 to each other. With such a configuration, it is possible to suppress unwanted resonance in the entirety of a package including the band pass filter 16. As a result, as denoted by the solid line in FIG. 13, an attenuation pole can be arranged in the demanded frequency range, and the desired frequency characteristics of the transmittance coefficient S21 can be obtained. In addition, the coupling characteristics between the two resonators 8 and 10 and each of the first input-output line 13 and the second input-output line 14 can be stabilized.

A third embodiment of the present disclosure will be described below with reference to FIGS. 14 to 17. The third embodiment is featured in including another even mode resonator that includes a linear conductor disposed inside the dielectric substrate and that is coupled to the above-mentioned even mode resonator. In the third embodiment, the same constituent elements as those in the first embodiment are denoted by the same reference signs, and the description of those constituent elements is omitted.

A band pass filter 21 according to the third embodiment includes, almost as in the band pass filter 1 according to the first embodiment, the dielectric substrate 2, the ground conductors 6 and 7, resonators 22 and 25, and input-output lines 28 and 29. In addition, the band pass filter 21 includes another resonator 31 that is coupled to the resonator 25.

Figure 14:
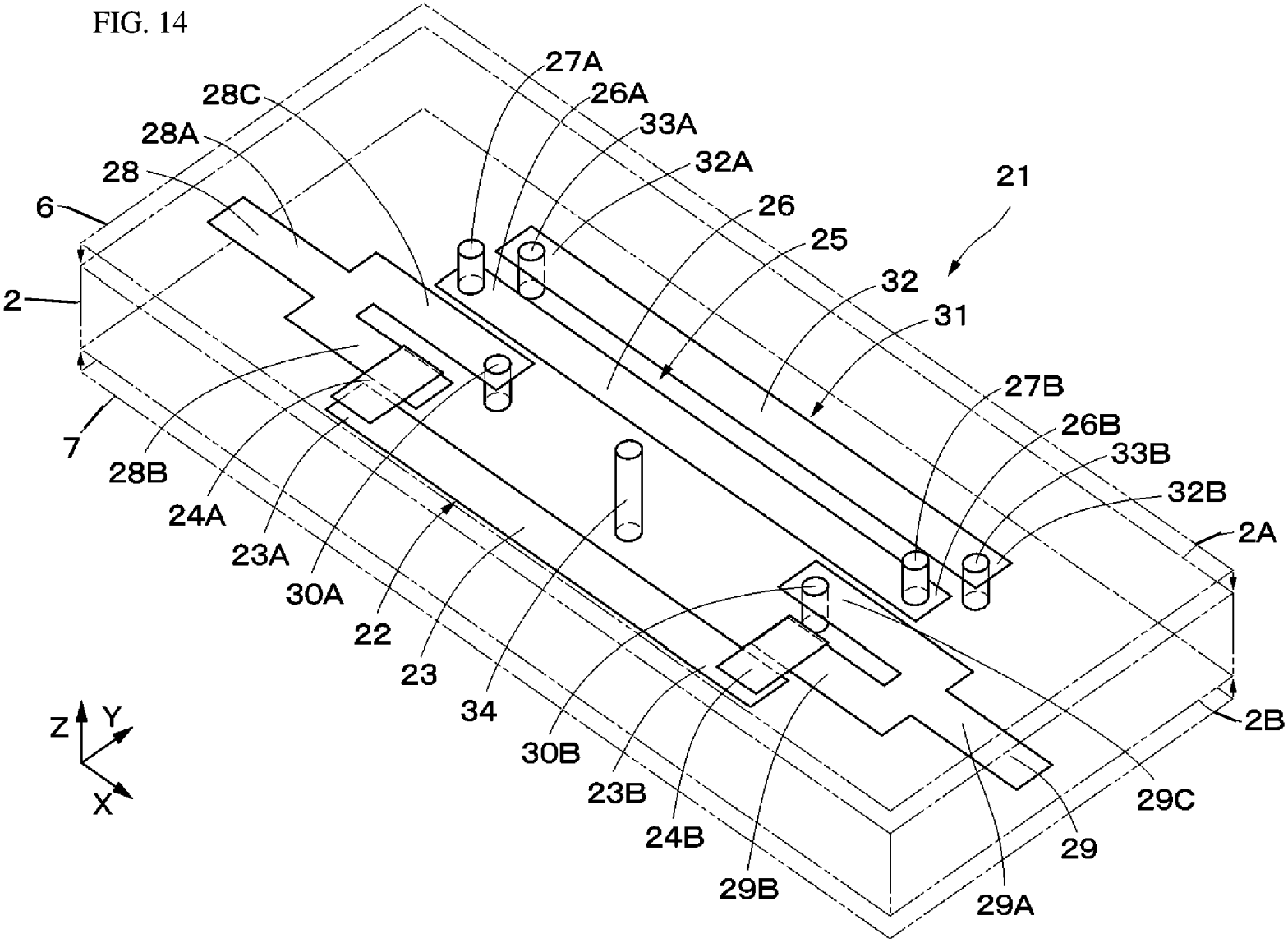
FIG. 14 is a perspective view of a band pass filter according to a third embodiment of the present disclosure.
Figure 15:
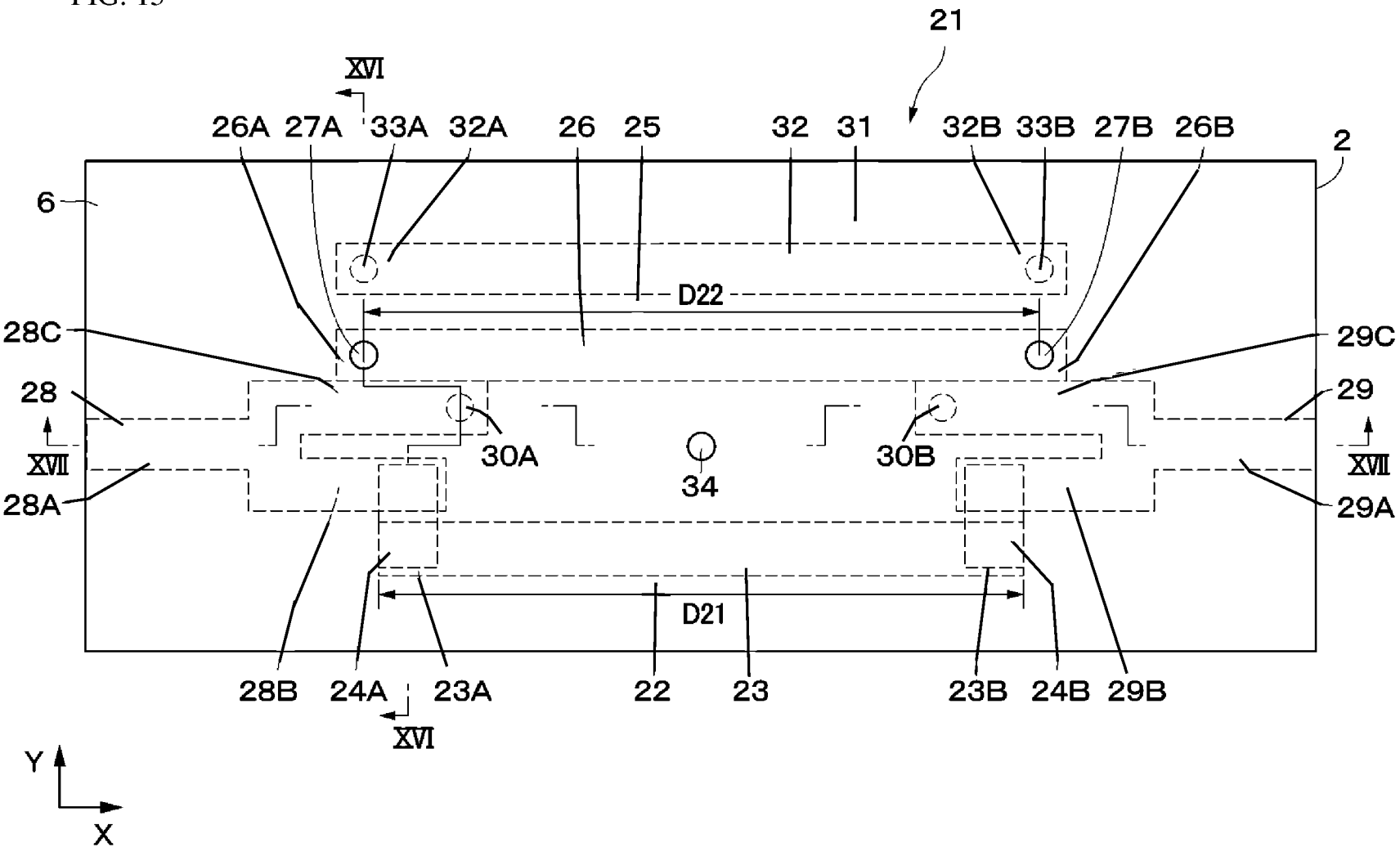
FIG. 15 is a plan view of the band pass filter illustrated in FIG. 14.
Figure 16:
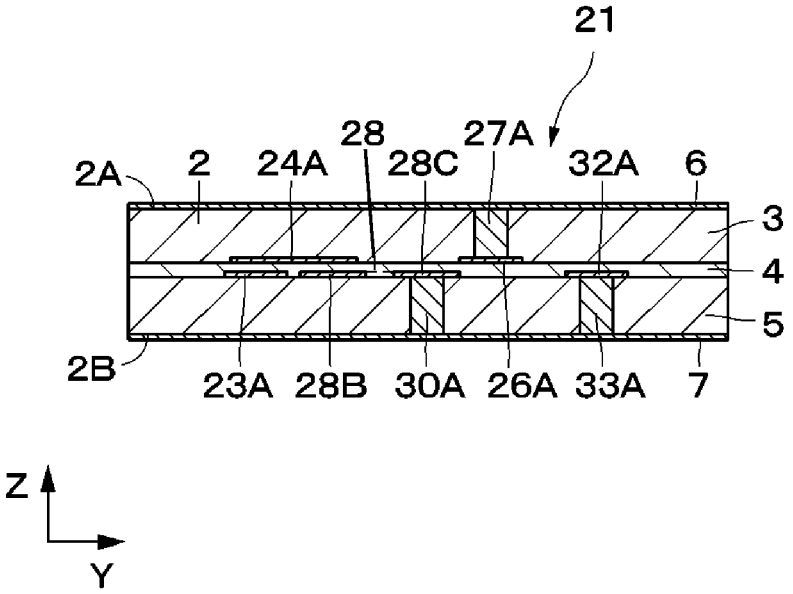
FIG. 16 is a sectional view of the band pass filter taken along XVI-XVI in FIG. 15 and viewed in a direction denoted by the arrow.
Figure 17:
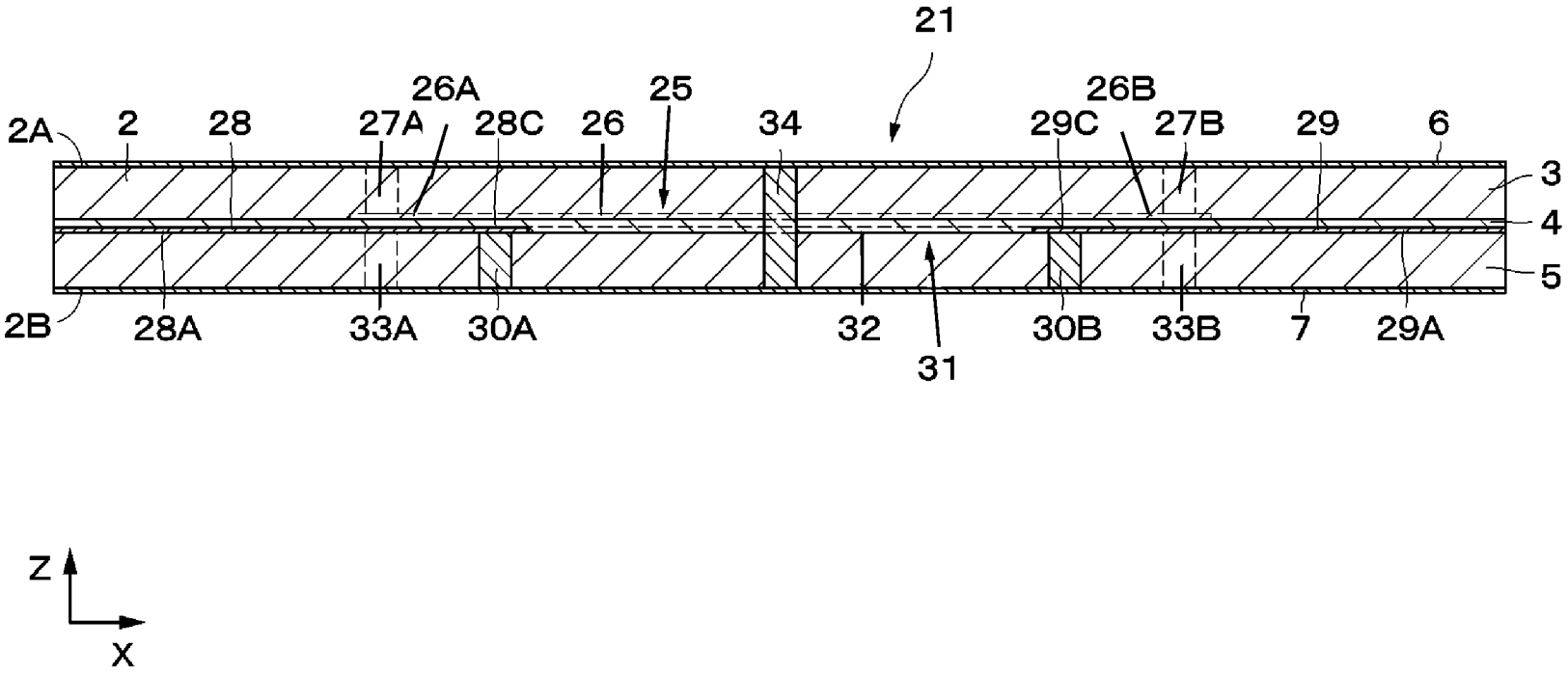
FIG. 17 is a sectional view of the band pass filter taken along XVII-XVII in FIG. 15 and viewed in a direction denoted by the arrow.

The resonator 22 is disposed inside the dielectric substrate 2 (see FIGS. 14 to 17). The resonator 22 includes a linear conductor 23. The linear conductor 23 is positioned between the insulating layer 4 and the insulating layer 5 and is formed in an elongate strip shape extending in the X-axis direction that is the lengthwise direction. As illustrated in FIG. 15, a length D21 of the linear conductor 23 in the X-axis direction is set to ½ of the wavelength in the dielectric substrate 2 corresponding to a first resonant frequency, for example. A first end 23A of the linear conductor 23 is positioned on the first end side in the X-axis direction and is covered with the insulating layers 4 and 5. A second end 23B of the linear conductor 23 is positioned on the second end side in the X-axis direction and is covered with the insulating layers 4 and 5. The first end 23A and the second end 23B of the linear conductor 23 are left open. Accordingly, the resonator 22 constitutes a half-wavelength resonator and also an odd mode resonator.

The first end 23A of the linear conductor 23 is opposed to a coupling conductor 24A with the insulating layer 4 interposed therebetween. The second end 23B of the linear conductor 23 is opposed to a coupling conductor 24B with the insulating layer 4 interposed therebetween. The coupling conductors 24A and 24B are positioned between the insulating layer 3 and the insulating layer 4 and extend in the Y-axis direction. The coupling conductor 24A is opposed to not only the first end 23A of the linear conductor 23, but also a coupling portion 28B of the input-output line 28. The coupling conductor 24B is opposed to not only the second end 23B of the linear conductor 23, but also a coupling portion 29B of the input-output line 29. Thus, the resonator 22 is coupled to the input-output lines 28 and 29. In the above-described configuration, the coupling between the resonator 22 and each of the input-output lines 28 and 29 is mainly capacitive coupling.

The resonator 25 is disposed inside the dielectric substrate 2 (see FIGS. 14 to 17). The resonator 25 includes a linear conductor 26. The linear conductor 26 is positioned between the insulating layer 3 and the insulating layer 4 and is formed in an elongate strip shape extending in the X-axis direction that is the lengthwise direction. The linear conductor 26 is spaced from the linear conductor 23 in the Y-axis direction. The linear conductor 26 extends in the X-axis direction parallel to the linear conductor 23.

As illustrated in FIG. 15, a length D22 of the linear conductor 26 in the X-axis direction is set to ½ of the wavelength in the dielectric substrate 2 corresponding to a second resonant frequency, for example. The length D22 is a length from a center of a via 27A to a center of a via 27B. Instead, a size resulting from adding heights of the vias 27A and 27B to the length D22 may be set to ½ of the wavelength in the dielectric substrate 2 corresponding to the second resonant frequency. The length D22 of the linear conductor 26 is, for example, longer than the length D21 of the linear conductor 23. The length D22 of the linear conductor 26 may be shorter than or equal to the length D21 of the linear conductor 23.

When the length D22 of the linear conductor 26 is shorter than the length D21 of the linear conductor 23, the resonant frequency of the odd mode resonator is lower than that of the even mode resonator. In this case, a frequency at a transfer zero point (attenuation pole) is higher than a pass band.

On the other hand, when the length D22 of the linear conductor 26 is longer than the length D21 of the linear conductor 23, the resonant frequency of the odd mode resonator is higher than that of the even mode resonator. In this case, the frequency at the transfer zero point (attenuation pole) is lower than the pass band.

A first end 26A of the linear conductor 26 is positioned on the first end side in the X-axis direction and is connected to the ground conductor 6 on the first surface 2A of the dielectric substrate 2 through the via 27A that serves as one first via. A second end 26B of the linear conductor 26 is positioned on the second end side in the X-axis direction and is connected to the ground conductor 6 on the first surface 2A of the dielectric substrate 2 through the via 27B that serves as the other first via. The vias 27A and 27B are each formed by a columnar conductor that extends in the thickness direction of the dielectric substrate 2 (namely, in the Z-axis direction) while penetrating through the insulating layer 3. The first end 26A and the second end 26B of the linear conductor 26 are short-circuited to the ground conductor 6. Accordingly, the resonator 25 constitutes a half-wavelength resonator and also an even mode resonator.

The pair of input-output lines 28 and 29 connect the two resonators 22 and 25 to the external circuits, and the two resonators 22 and 25 are connected in parallel between the pair of input-output lines 28 and 29 (see FIGS. 14 and 15). The input-output line 28 is the first input-output line. The input-output line 28 is positioned on the first end side in the X-axis direction and is arranged between the insulating layer 4 and the insulating layer 5. The input-output line 29 is the second input-output line. The input-output line 29 is positioned on the second end side in the X-axis direction and is arranged between the insulating layer 4 and the insulating layer 5.

The input-output line 28 is arranged at a position closer to the first ends 23A and 26A of the linear conductors 23 and 26 of the two resonators 22 and 25 than the second ends 23B and 26B thereof. The input-output line 28 includes a transfer line portion 28A, a first coupling portion 28B, and a second coupling portion 28C. The transfer line portion 28A is formed in an elongate strip shape extending in the X-axis direction. The first coupling portion 28B is branched from the transfer line portion 28A, extends toward the resonator 22, and is opposed to the coupling conductor 24A in the thickness direction with the insulating layer 4 interposed therebetween. The first coupling portion 28B is coupled to the first end 23A of the linear conductor 23 through the coupling conductor 24A. In the above-described configuration, the coupling between the first coupling portion 28B of the input-output line 28 and the first end 23A of the linear conductor 23 is mainly capacitive coupling.

The second coupling portion 28C is branched from the transfer line portion 28A, extends toward the resonator 25, and is arranged at a position closer to the first end 26A of the linear conductors 26 than the first end 23A of the linear conductor 23. The second coupling portion 28C is connected to the ground conductor 7 on the second surface 2B of the dielectric substrate 2 through a via 30A that serves as one second via. The via 30A is formed by a columnar conductor that extends in the thickness direction of the dielectric substrate 2 (namely, in the Z-axis direction) while penetrating through the insulating layer 5. The via 30A for the input-output line 28 is arranged at a position near the via 27A for the resonator 25, but different from the position of the via 27A in the Y-axis direction. The via 30A for the input-output line 28 and the via 27A for the resonator 25 extend in opposite directions with respect to the thickness direction of the dielectric substrate 2 (namely, in the Z-axis direction) (see FIGS. 14, 16 and 17). The second coupling portion 28C is coupled to the first end 26A of the linear conductor 26. In the above-described configuration, the coupling between the second coupling portion 28C of the input-output line 28 and the first end 26A of the linear conductor 26 is mainly magnetic field coupling.

The input-output line 29 is arranged at a position closer to the second ends 23B and 26B of the linear conductors 23 and 26 of the two resonators 22 and 25 than the first ends 23A and 26A thereof. The input-output line 29 includes, as in the input-output line 28, a transfer line portion 29A, a first coupling portion 29B, and a second coupling portion 29C. The transfer line portion 29A is formed in an elongate strip shape extending in the X-axis direction. The first coupling portion 29B is branched from the transfer line portion 29A, extends toward the resonator 22, and is opposed to the coupling conductor 24B in the thickness direction with the insulating layer 4 interposed therebetween. The first coupling portion 29B is coupled to the second end 23B of the linear conductor 23 through the coupling conductor 24B. In the above-described configuration, the coupling between the first coupling portion 29B of the input-output line 29 and the second end 23B of the linear conductor 23 is mainly capacitive coupling.

The second coupling portion 29C is branched from the transfer line portion 29A, extends toward the resonator 25, and is arranged at a position closer to the second end 26B of the linear conductors 26 than the second end 23B of the linear conductor 23. The second coupling portion 29C is connected to the ground conductor 7 on the second surface 2B of the dielectric substrate 2 through a via 30B that serves as the other second via. The via 30B is formed by a columnar conductor that extends in the thickness direction of the dielectric substrate 2 (namely, in the Z-axis direction) while penetrating through the insulating layer 5. The via 30B for the input-output line 29 is arranged at a position near the via 27B for the resonator 25, but different from the position of the via 27B in the Y-axis direction. The via 30B for the input-output line 29 and the via 27B for the resonator 25 extend in the opposite directions with respect to the thickness direction of the dielectric substrate 2 (namely, in the Z-axis direction) (see FIGS. 14 and 17). The second coupling portion 29C is coupled to the second end 26B of the linear conductor 26. In the above-described configuration, the coupling between the second coupling portion 29C of the input-output line 29 and the second end 26B of the linear conductor 26 is mainly magnetic field coupling.

The resonator 31 is disposed inside the dielectric substrate 2 (see FIGS. 14 to 17). The resonator 31 includes a linear conductor 32. The linear conductor 32 is positioned between the insulating layer 4 and the insulating layer 5 and is formed in an elongate strip shape extending in the X-axis direction that is the lengthwise direction. The linear conductor 32 is spaced from the linear conductor 26 in the Y-axis direction. The linear conductor 32 extends in the X-axis direction parallel to the linear conductor 26. The linear conductor 32 is arranged at a different position from the linear conductor 26 in the thickness direction of the dielectric substrate 2. In this case, since a distance between the linear conductor 32 and the linear conductor 26 can be made longer without changing the distance between the linear conductors 32 and 26 in the Y-axis direction, the coupling strength can be adjusted. The linear conductor 32 may be arranged at the same position as the linear conductor 26 in the thickness direction of the dielectric substrate 2, namely between the insulating layer 3 and the insulating layer 4.

The linear conductor 32 has, for example, the same length D22 as the linear conductor 26. The linear conductor 32 may have a different length from the linear conductor 26.

A first end 32A of the linear conductor 32 is positioned on the first end side in the X-axis direction and is connected to the ground conductor 7 on the second surface 2B of the dielectric substrate 2 through a via 33A that serves as one third via. A second end 32B of the linear conductor 32 is positioned on the second end side in the X-axis direction and is connected to the ground conductor 7 on the second surface 2B of the dielectric substrate 2 through a via 33B that serves as the other third via. The vias 33A and 33B are each formed by a columnar conductor that extends in the thickness direction of the dielectric substrate 2 (namely, in the Z-axis direction) while penetrating through the insulating layer 5. The vias 33A and 33B for the resonator 31 are arranged near the vias 27A and 27B for the resonator 25, respectively. In addition, the vias 33A and 33B for the resonator 31 are arranged on an opposite side to the vias 30A and 30B for the input-output lines 28 and 29 in the Y-axis direction with the vias 27A and 27B for the resonator 25 interposed therebetween. The first end 32A and the second end 32B of the linear conductor 32 are short-circuited to the ground conductor 7. Accordingly, the resonator 31 constitutes a half-wavelength resonator and also an even mode resonator.

Furthermore, the linear conductor 32 is arranged on an opposite side to the linear conductor 23 in the Y-axis direction with the linear conductor 26 interposed therebetween. Therefore, the resonator 31 is not coupled to the resonator 22 and is coupled to the resonator 25. Moreover, the vias 33A and 33B for the resonator 31 and the vias 27A and 27B for the resonator 25 extend in the opposite directions with respect to the thickness direction of the dielectric substrate 2 (namely, in the Z-axis direction) (see FIGS. 14, 16 and 17).

A penetration via 34 is positioned between the two resonators 22 and 25, penetrates through the dielectric substrate 2 in the thickness direction, and connects the ground conductor 6 on the first surface 2A of the dielectric substrate 2 and the ground conductor 7 on the second surface 2B of the dielectric substrate 2 to each other. The penetration via 34 is arranged, for example, near a middle position between the resonator 22 and the resonator 25 with respect to the Y-axis direction.

The relations of the vias 27A and 27B for the resonator 25 and the vias 33A and 33B for the resonator 31 to a coupling coefficient will be described below with reference to FIGS. 18 to 20.

In the case of coupling the two resonator 25 and 31 that are constituted as the even mode resonators, the coupling coefficient between those two resonators is apt to decrease. Hence the fractional band width of the band pass filter tends to narrow.

As a result of conducting intensive studies, however, the inventor of this application has found that the coupling coefficient can be increased by connecting the vias 27A and 27B for the resonator 25 and the vias 33A and 33B for the resonator 31 to the different ground conductors 6 and 7, respectively. In order to confirm the above-mentioned effect, the coupling coefficient is calculated for each of a calculation model 121 illustrated in FIG. 18 in which vias in two resonators to be coupled extend in opposite directions, and a calculation model 131 illustrated in FIG. 19 in which vias in two resonators to be coupled extend in the same direction.

Figure 18:
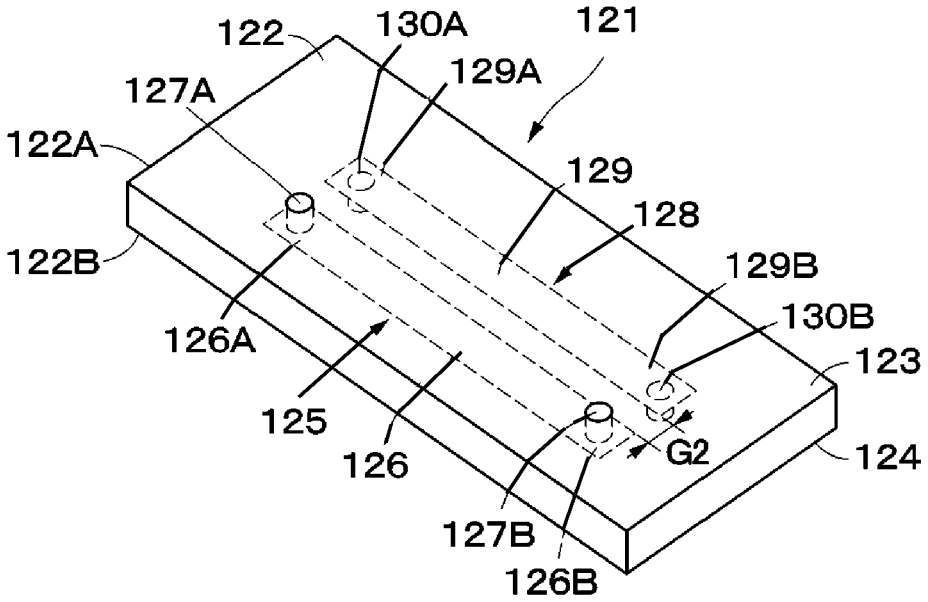
FIG. 18 is a perspective view of a calculation model when vias for two resonators coupled to each other extend in opposite directions.

Here, the calculation model 121 includes a dielectric substrate 122, ground conductors 123 and 124, and two resonators 125 and 128 (see FIG. 18). The ground conductor 123 is disposed on a first surface 122A of the dielectric substrate 122. The ground conductor 124 is disposed on a second surface 122B of the dielectric substrate 122. The resonator 125 includes a linear conductor 126 disposed inside the dielectric substrate 122. A first end 126A and a second end 126B of the linear conductor 126 are connected to the ground conductor 123 through vias 127A and 127B, respectively. The resonator 128 includes a linear conductor 129 disposed inside the dielectric substrate 122. The linear conductor 129 extends parallel to the linear conductor 126 in a state not in contact with the linear conductor 126. A first end 129A and a second end 129B of the linear conductor 129 are connected to the ground conductor 124 through vias 130A and 130B, respectively. Thus, in the calculation model 121, the vias 127A and 127B for the resonator 125 and the vias 130A and 130B for the resonator 128 extend in opposite directions (in staggered layout) with respect to a thickness direction of the dielectric substrate 122, and hence constitute the vias in the opposite directions.

Figure 19:
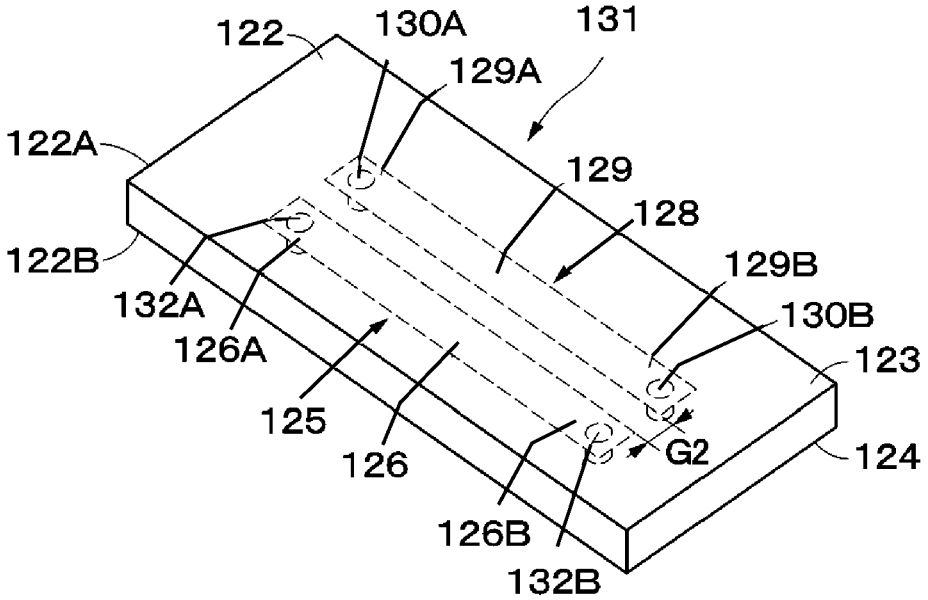
FIG. 19 is a perspective view of a calculation model when the vias for the two resonators coupled to each other extend in the same direction.

The calculation model 131 includes, almost as in the calculation model 121, the dielectric substrate 122, the ground conductors 123 and 124, and the two resonators 125 and 128 (see FIG. 19). However, the first end 126A and the second end 126B of the linear conductor 126 are connected to the ground conductor 124 through vias 132A and 132B, respectively. Thus, in the calculation model 131, the vias 132A and 132B for the resonator 125 and the vias 130A and 130B for the resonator 128 extend in the same direction with respect to the thickness direction of the dielectric substrate 122, and hence constitute the vias in the same direction.

The relation of a gap G2 between the linear conductors 126 and 129 of the resonators 125 and 128 to the coupling coefficient is determined for each of the above-described calculation models 121 and 131. FIG. 20 illustrates the determined results.

Figure 20:
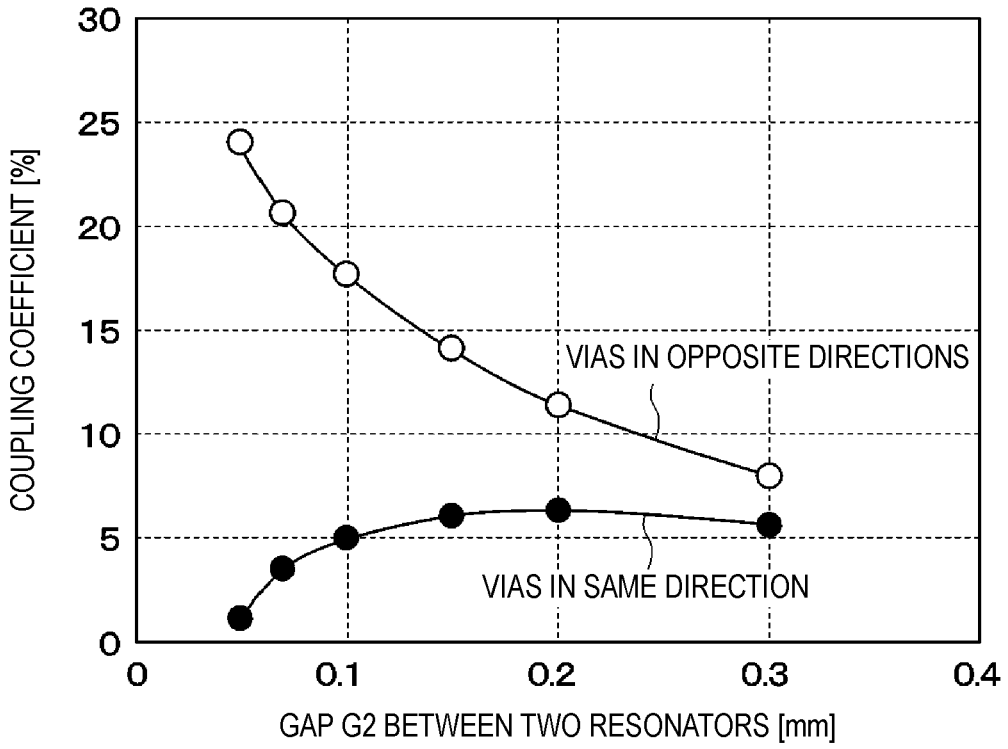
FIG. 20 illustrates characteristic curves representing the relation of a gap between the two resonators to a coupling coefficient.

As illustrated in FIG. 20, in the calculation model 131 including the vias in the same direction, the coupling coefficient tends to decrease as the gap G2 decreases. On the other hand, in the calculation model 121 including the vias in the opposite directions, it is seen that the coupling coefficient increases as the gap G2 decreases. Particularly, when the gap G2 is 0.2 mm or less, the coupling coefficient increases above 10%. Accordingly, the fractional band width of the band pass filter can be widened.

In the band pass filter 21 according to the third embodiment, as in the calculation model 121, the vias 27A and 27B for the resonator 25 and the vias 33A and 33B for the resonator 31 extend in the opposite directions with respect to the thickness direction of the dielectric substrate 2. Therefore, the fractional band width of the band pass filter can be widened in the band pass filter 21 according to the third embodiment as well.

Figure 21:
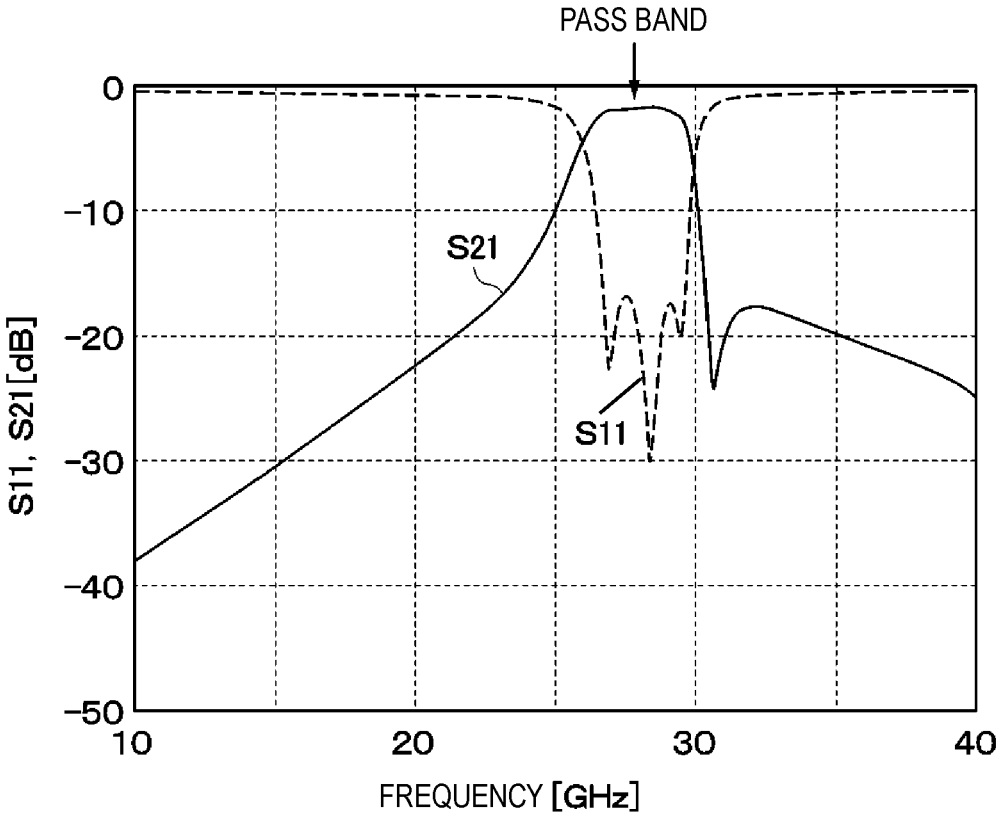
FIG. 21 illustrates characteristic curves representing frequency characteristics of the transmittance coefficient and the reflection coefficient in the band pass filter according to the third embodiment.

In order to confirm the filtering characteristics of the band pass filter 21 according to the third embodiment, the frequency characteristics of the S parameters, namely S11 (reflection coefficient) and S21 (transmittance coefficient), are determined. FIG. 21 illustrates an example of the determined results.

In the band pass filter 21 according to this embodiment, as illustrated in FIG. 21, the reflection coefficient S11 increases toward a minus direction from 0 dB and the transmittance coefficient S21 comes close to 0 dB near a range of 27 to 30 GHz, namely a pass band. Thus, it is confirmed that the band pass filter 21 can operate as a band pass filter having a bandpass characteristic with the fractional band width of 10% or more, for example.

In the third embodiment with the above-described configuration as well, the external Q of the resonator 25 is reduced and the fractional band width of the band pass filter 21 can be widened. Furthermore, in the third embodiment, since the additional resonator 31 is disposed in the dielectric substrate 2 to be coupled to the resonator 25, a 3-stage Cul-de-Sac coupled filter made up of the three resonators 22, 25 and 31 can be constituted. The 3-stage Cul-de-Sac coupled filter has a coupling configuration including a resonator that is not directly coupled to an input stage and an output stage. In the band pass filter 21 illustrated in FIG. 15, the resonator 31 is not directly coupled to the input stage and the output stage. As a result, sharper attenuation characteristics can be obtained in comparison with the band pass filter 1 according to the first embodiment which is constituted by the two resonators 8 and 10.

Moreover, the resonator 25 includes the vias 27A and 27B that are disposed to be connected to both the ends of the linear conductor 26 thereof and connected to the ground conductor 6 on the first surface 2A of the dielectric substrate 2, and the resonator 31 includes the vias 33A and 33B that are disposed to be connected to both the ends of the linear conductor 32 thereof and connected to the ground conductor 7 on the second surface 2B of the dielectric substrate 2.

With the above-described configuration, the two resonators 25 and 31 operate as even mode resonators of which both ends are connected to the ground conductors 6 and 7, respectively. Here, the vias 27A and 27B for the resonator 25 and the vias 33A and 33B for the resonator 31 extend in the opposite directions with respect to the thickness direction of the dielectric substrate 2 and are connected to the different ground conductors 6 and 7, respectively. As a result, the coupling coefficient between the two resonators 25 and 31 is increased and the fractional band width of the band pass filter 21 can be widened in comparison with the case in which the vias 27A and 27B for the resonator 25 and the vias 33A and 33B for the resonator 31 are connected to the same ground conductor.

Although the vias 27A and 27B for the resonator 25 are both connected to the same ground conductor 6, the vias 27A and 27B may be connected to the different ground conductors 6 and 7, respectively. For example, the via 27A for the resonator 25 may be connected to the ground conductor 6, and the via 27B for the resonator 25 may be connected to the ground conductor 7. In such a case, the via 33A for the resonator 31 is connected to the ground conductor 7, and the via 33B for the resonator 31 is connected to the ground conductor 6. The above-mentioned configuration can also widen the fractional band width of the band pass filter.

The band pass filter 21 further includes a penetration via 34 that is positioned between the two resonators 22 and 25, that penetrates through the dielectric substrate 2 in the thickness direction, and that connects the ground conductor 6 on the first surface 2A of the dielectric substrate 2 and the ground conductor 7 on the second surface 2B of the dielectric substrate 2 to each other. With the above-described configuration, as in the band pass filter 16 according to the second embodiment, it is possible to suppress unwanted resonance in the entirety of a package including the band pass filter 21. As a result, an attenuation pole can be arranged in the demanded frequency range, and the desired frequency characteristics of the transmittance coefficient S21 can be obtained. In addition, the coupling characteristics between the two resonators 22 and 25 and the input-output lines 28 and 29 can be stabilized.

Figure 22:
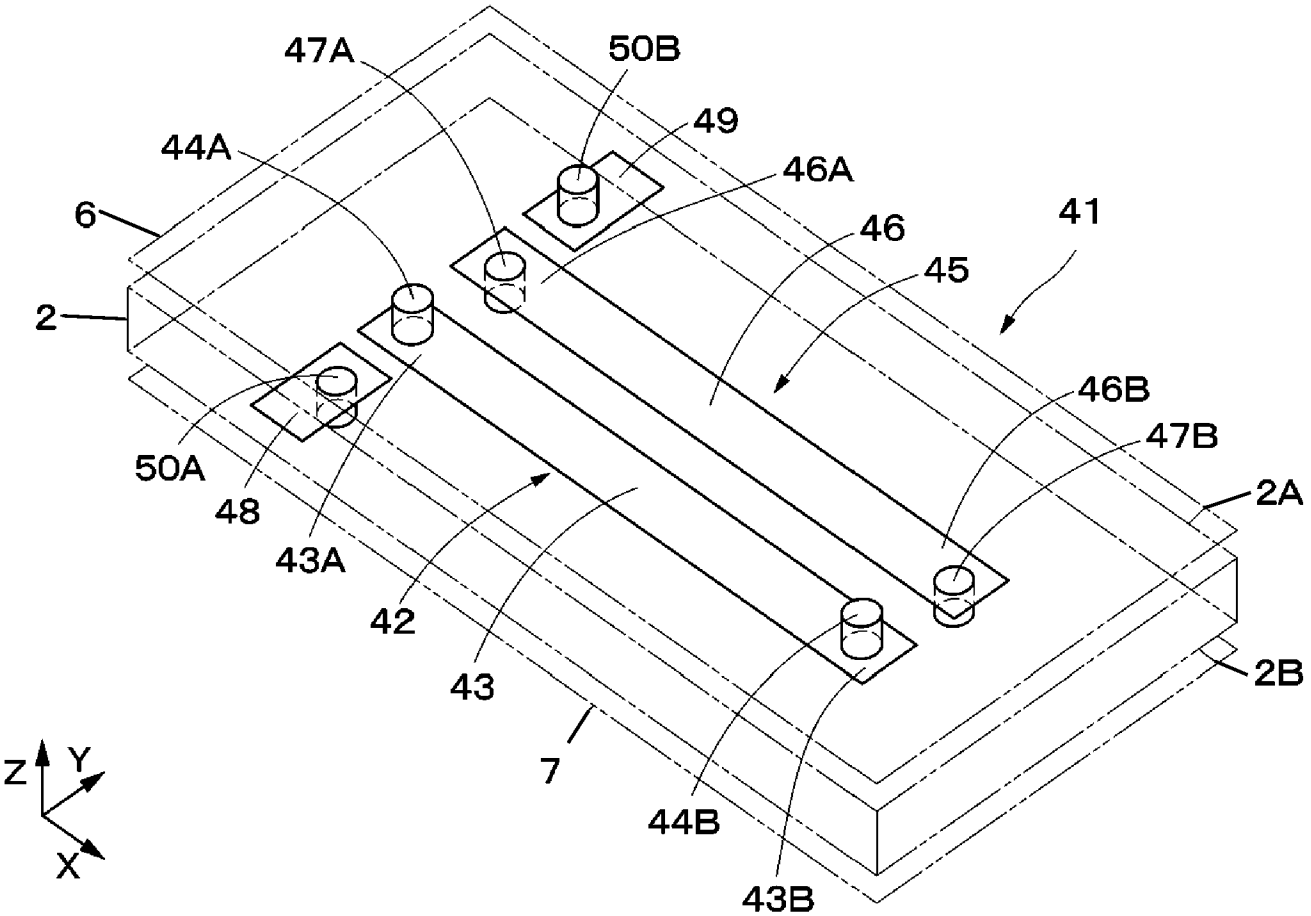
FIG. 22 is a perspective view of a band pass filter according to a fourth embodiment of the present disclosure.

A fourth embodiment of the present disclosure will be described below with reference to FIG. 22. The fourth embodiment is featured in that two even mode resonators are coupled to each other, and that vias for one of the even mode resonators and vias for the other even mode resonator are connected to different ground conductors. In the fourth embodiment, the same constituent elements as those in the first embodiment are denoted by the same reference signs, and the description of those constituent elements is omitted.

A band pass filter 41 according to the fourth embodiment includes, almost as in the band pass filter 1 according to the first embodiment, the dielectric substrate 2, the ground conductors 6 and 7, resonators 42 and 45, and input-output lines 48 and 49.

The resonator 42 is disposed inside the dielectric substrate 2. The resonator 42 includes a linear conductor 43. The linear conductor 43 is positioned inside the dielectric substrate 2 and is formed in an elongate strip shape extending in the X-axis direction that is the lengthwise direction. A length of the linear conductor 43 in the X-axis direction is set to ½ of the wavelength in the dielectric substrate 2 corresponding to the first resonant frequency, for example. The length of the linear conductor 43 in the X-axis direction is, for example, a length from a center of a via 44A to a center of a via 44B.

A first end 43A of the linear conductor 43 is positioned on the first end side in the X-axis direction and is connected to the ground conductor 6 on the first surface 2A of the dielectric substrate 2 through the via 44A that serves as one first-surface side via. A second end 43B of the linear conductor 43 is positioned on the second end side in the X-axis direction and is connected to the ground conductor 6 on the first surface 2A of the dielectric substrate 2 through the via 44B that serves as the other first-surface side via. The vias 44A and 44B are each formed by a columnar conductor that extends in the thickness direction of the dielectric substrate 2 (namely, in the Z-axis direction). The first end 43A and the second end 43B of the linear conductor 43 are short-circuited to the ground conductor 6. Accordingly, the resonator 42 constitutes a half-wavelength resonator and also an even mode resonator.

The resonator 45 is disposed inside the dielectric substrate 2. The resonator 45 includes a linear conductor 46. The linear conductor 46 is positioned inside the dielectric substrate 2 and is formed in an elongate strip shape extending in the X-axis direction that is the lengthwise direction. The linear conductor 46 is spaced from the linear conductor 43 in the Y-axis direction. The linear conductor 46 extends in the X-axis direction parallel to the linear conductor 43.

A length of the linear conductor 46 in the X-axis direction is set to ½ of the wavelength in the dielectric substrate 2 corresponding to the second resonant frequency, for example. The length of the linear conductor 46 in the X-axis direction is, for example, a length from a center of a via 47A to a center of a via 47B. The length of the linear conductor 46 may be different from or equal to that of the linear conductor 43.

A first end 46A of the linear conductor 46 is positioned on the first end side in the X-axis direction and is connected to the ground conductor 7 on the second surface 2B of the dielectric substrate 2 through the via 47A that serves as one second-surface side via. A second end 46B of the linear conductor 46 is positioned on the second end side in the X-axis direction and is connected to the ground conductor 7 on the second surface 2B of the dielectric substrate 2 through the via 47B that serves as the other second-surface side via. The vias 47A and 47B are each formed by a columnar conductor that extends in the thickness direction of the dielectric substrate 2 (namely, in the Z-axis direction). The first end 46A and the second end 46B of the linear conductor 46 are short-circuited to the ground conductor 7. Accordingly, the resonator 45 constitutes a half-wavelength resonator and also an even mode resonator.

The pair of input-output lines 48 and 49 connect the two resonators 42 and 45 to the external circuits, and the two resonators 42 and 45 are connected in series between the pair of input-output lines 48 and 49. The pair of input-output lines 48 and 49 are arranged respectively on both sides of the two resonators 42 and 45 so as to sandwich those the resonators therebetween in the Y-axis direction. One input-output line 48 is positioned on a first end side in the Y-axis direction. The other input-output line 49 is positioned on a second end side in the Y-axis direction.

The input-output line 48 is a first input-output line. The input-output line 48 is arranged at a position closer to the first end 43A of the linear conductor 43 of the resonator 42 than the second end 43B thereof. Instead, the input-output line 48 may be arranged at a position closer to the second end 43B of the linear conductor 43 of the resonator 42 than the first end 43A thereof. The input-output line 48 is connected to the ground conductor 7 on the second surface 2B of the dielectric substrate 2 through a via 50A that serves as one line-side via for connection to an input-output. The via 50A for the input-output line 48 and the via 44A for the resonator 42 extend in the opposite directions with respect to the thickness direction of the dielectric substrate 2 (namely, in the Z-axis direction). The input-output line 48 is arranged on an opposite side to the resonator 45 with the resonator 42 interposed therebetween. Therefore, the input-output line 48 is not coupled to the resonator 45 and is coupled to the resonator 42.

The input-output line 49 is a second input-output line. The input-output line 49 is arranged at a position closer to the first end 46A of the linear conductor 46 of the resonator 45 than the second end 46B thereof. Instead, the input-output line 49 may be arranged at a position closer to the second end 46B of the linear conductor 46 of the resonator 45 than the first end 46A thereof. The input-output line 49 is connected to the ground conductor 6 on the first surface 2A of the dielectric substrate 2 through a via 50B that serves as the other line-side via for connection to an input-output. The via 50B for the input-output line 49 and the via 47A for the resonator 45 extend in the opposite directions with respect to the thickness direction of the dielectric substrate 2 (namely, in the Z-axis direction). The input-output line 49 is arranged on an opposite side to the resonator 42 with the resonator 45 interposed therebetween. Therefore, the input-output line 49 is not coupled to the resonator 42 and is coupled to the resonator 45. Hence the two resonators 42 and 45 are connected in series between the pair of input-output lines 48 and 49.

As described above, the band pass filter 41 according to the fourth embodiment includes the dielectric substrate 2, the ground conductors 6 and 7 disposed respectively on the first surface 2A and the second surface 2B of the dielectric substrate 2, the resonator 42 including the linear conductor 43 disposed inside the dielectric substrate 2, and the resonator 45 including the linear conductor 46 disposed inside the dielectric substrate 2, the resonator 45 being coupled to the resonator 42.

In addition, the resonator 42 includes the pair of first-surface side vias 44A and 44B respectively through which both the ends of the linear conductor 43 of the resonator 42 are connected to the ground conductor 6 on the first surface 2A of the dielectric substrate 2, and the resonator 45 includes the pair of second-surface side vias 47A and 47B respectively through which both the ends of the linear conductor 46 of the resonator 45 are connected to the ground conductor 7 on the second surface 2B of the dielectric substrate 2.

With the above-described configuration, the two resonators 42 and 45 operate as even mode resonators of which both ends are connected to the ground conductors 6 and 7, respectively. Furthermore, the vias 44A and 44B for the resonator 42 and the vias 47A and 47B for the resonator 45 extend in the opposite directions with respect to the thickness direction of the dielectric substrate 2 and are connected to the different ground conductors 6 and 7. As a result, the coupling coefficient between the two resonators 42 and 45 is increased and the fractional band width of the band pass filter 41 can be widened in comparison with, for example, the case in which the vias 44A and 44B for the resonator 42 and the vias 47A and 47B for the resonator 45 are connected to the same ground conductor.

Furthermore, the band pass filter 41 includes the input-output line 48 and the input-output line 49 which connect the two resonators 42 and 45 to the external circuits and to which the two resonators 42 and 45 are connected in series. Thus, the two resonators 42 and 45 are connected in series between the input-output line 48 and the input-output line 49, whereby a resonator cascade-connected filter can be constituted.

The input-output line 48 is connected to the ground conductor 7 on the second surface 2B of the dielectric substrate 2 through the line-side via 50A and is coupled to the linear conductor 43 of the resonator 42. The input-output line 49 is connected to the ground conductor 6 on the first surface 2A of the dielectric substrate 2 through the line-side via 50B and is coupled to the linear conductor 46 of the resonator 45. The coupling between the input-output line 48 and the linear conductor 43 is mainly magnetic field coupling. The coupling between the input-output line 49 and the linear conductor 46 is mainly magnetic field coupling.

In addition, the via 44A for the resonator 42 and the via 50A for the input-output lines 48 extend in the opposite directions with respect to the thickness direction of the dielectric substrate 2 and are connected to the different ground conductors 6 and 7. As a result, the external Q of the resonator 42 operating as the even mode resonator is reduced and the fractional band width of the band pass filter 41 can be widened in comparison with the case in which the via 44A for the resonator 42 and the via 50A for the input-output line 48 are connected to the same ground conductor. The above-mentioned effect can also be obtained between the resonator 45 and the input-output line 49.

Figure 23:
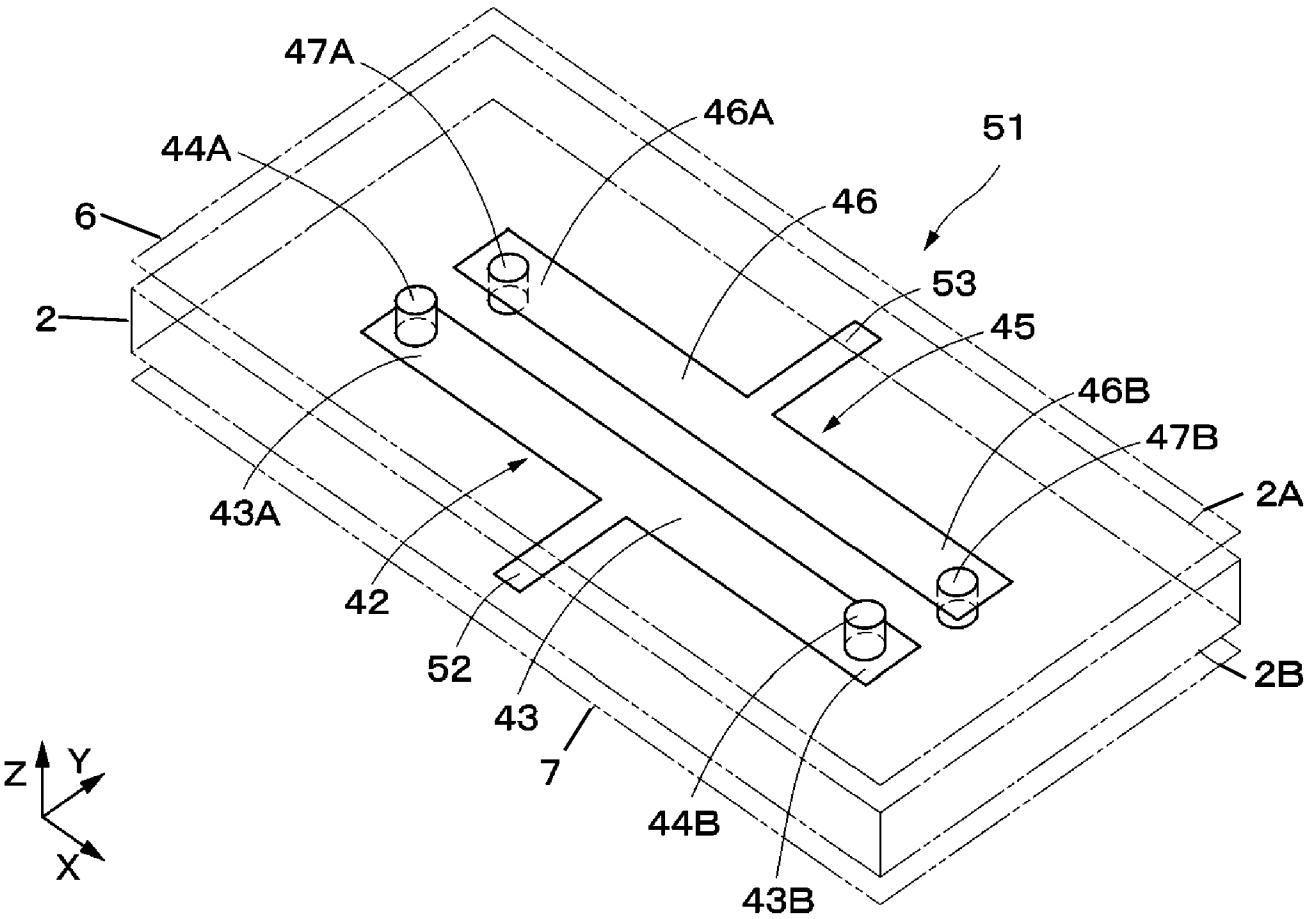
FIG. 23 is a perspective view of a band pass filter according to a third modification.

In the fourth embodiment described above, the input-output lines 48 and 49 are not in contact with the linear conductors 43 and 46 of the resonators 42 and 45, respectively. However, the present disclosure is not limited to that case. Like a band pass filter 51 according to a third modification illustrated in FIG. 23, for example, the band pass filter may include input-output lines 52 and 53 that are in contact with the linear conductors 43 and 46 of the resonators 42 and 45, respectively. More specifically, in the third modification, the input-output line 52 is a first input-output line and is directly connected to the linear conductor 43 of the resonator 42. The input-output line 53 is a second input-output line and is directly connected to the linear conductor 46 of the resonator 45. The band pass filter 51 according to the third modification can also provide a similar effect to that obtained with the fourth embodiment.

Figure 24:
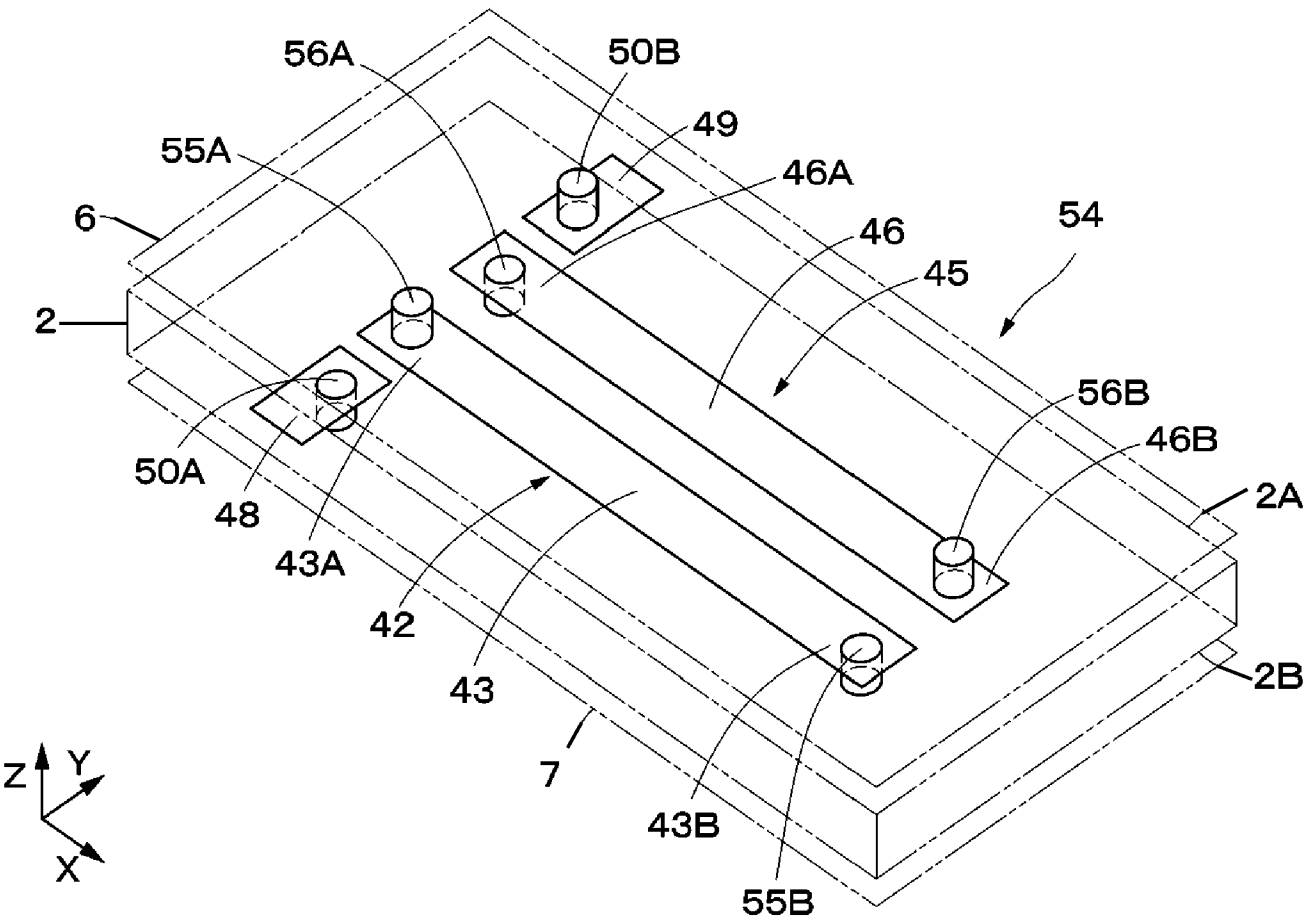
FIG. 24 is a perspective view of a band pass filter according to a fifth embodiment of the present disclosure.

A fifth embodiment of the present disclosure will be described below with reference to FIG. 24. The fifth embodiment is featured in that a first end of a linear conductor of one even mode resonator is connected to the ground conductor on the first surface of the dielectric substrate, a second end of the linear conductor of the one even mode resonator is connected to the ground conductor on the second surface of the dielectric substrate, a first end of a linear conductor of the other even mode resonator is connected to the ground conductor on the second surface of the dielectric substrate, and a second end of the linear conductor of the other even mode resonator is connected to the ground conductor on the first surface of the dielectric substrate. In the fifth embodiment, the same constituent elements as those in the fourth embodiment are denoted by the same reference signs, and the description of those constituent elements is omitted.

A band pass filter 54 according to the fifth embodiment includes, almost as in the band pass filter 41 according to the fourth embodiment, the dielectric substrate 2, the ground conductors 6 and 7, the resonators 42 and 45, and the input-output lines 48 and 49.

The resonator 42 includes the linear conductor 43. The first end 43A of the linear conductor 43 is connected to the ground conductor 6 on the first surface 2A of the dielectric substrate 2 through a via 55A that serves as one first-surface side via. The second end 43B of the linear conductor 43 is connected to the ground conductor 7 on the second surface 2B of the dielectric substrate 2 through a via 55B that serves as one second-surface side via.

The resonator 45 includes the linear conductor 46. The first end 46A of the linear conductor 46 is connected to the ground conductor 7 on the second surface 2B of the dielectric substrate 2 through a via 56A that serves as the other second-surface side via. The second end 46B of the linear conductor 46 is connected to the ground conductor 6 on the first surface 2A of the dielectric substrate 2 through a via 56B that serves as the other first-surface side via.

Thus, in the fifth embodiment with the above-described configuration as well, the coupling coefficient between the two resonators 42 and 45 is increased and the fractional band width of the band pass filter 54 can be widened.

Figure 25:
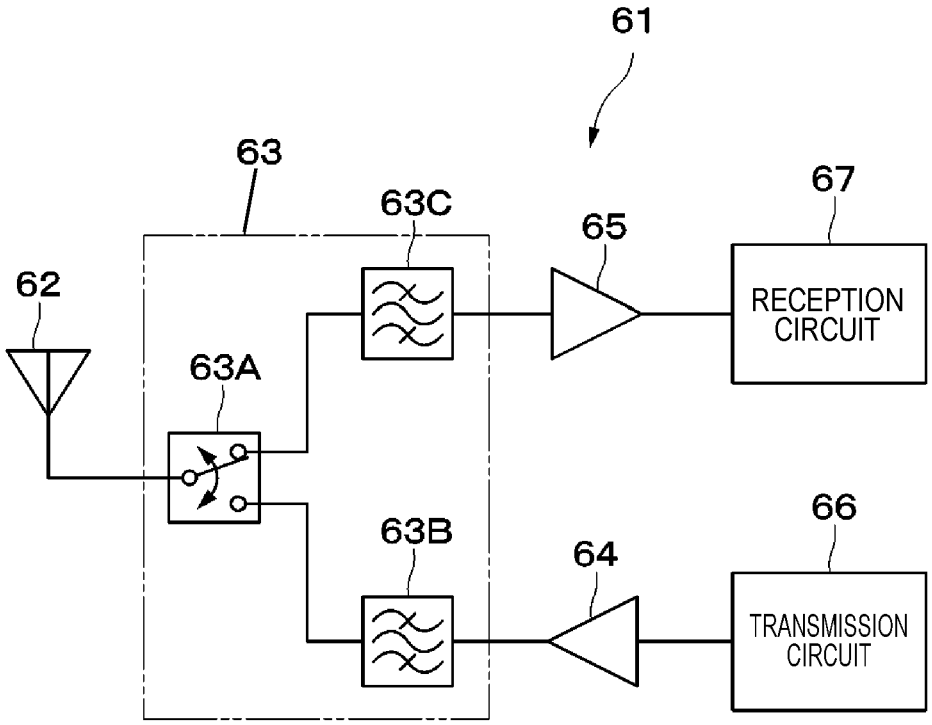
FIG. 25 is a block diagram of a communication device according to a sixth embodiment of the present disclosure.

A sixth embodiment of the present disclosure will be described below with reference to FIG. 25. The sixth embodiment is featured in that a communication device is constituted using band pass filters. In the sixth embodiment, the same constituent elements as those in the first embodiment are denoted by the same reference signs, and the description of those constituent elements is omitted.

A communication device 61 according to the sixth embodiment includes an antenna 62, an antenna duplexer 63, a power amplifier 64, a low-noise amplifier 65, a transmission circuit 66, and a reception circuit 67. The transmission circuit 66 is connected to the antenna 62 through the power amplifier 64 and the antenna duplexer 63. The reception circuit 67 is connected to the antenna 62 through the low-noise amplifier 65 and the antenna duplexer 63.

The antenna duplexer 63 includes a changeover switch 63A and two band pass filters 63B and 63C. The changeover switch 63A selectively connects one of the transmission circuit 66 and the reception circuit 67 to the antenna 62. The changeover switch 63A selectively switches between a transmission state and a reception state of the communication device 61. The band pass filter 63B on a transmission side is connected between the changeover switch 63A and the power amplifier 64. The band pass filter 63C on a reception side is connected between the changeover switch 63A and the low-noise amplifier 65. The band pass filters 63B and 63C are each constituted by, for example, the band pass filter 1 according to the first embodiment. Instead, the band pass filters 63B and 63C may be each constituted by any one of the band pass filters 16, 21, 41 and 54 according to the second to fifth embodiments.

Thus, in the sixth embodiment with the above-described configuration as well, the fractional band width of each of the band pass filters 63B and 63C can be widened.

Although, in the above-described embodiments, the linear conductors 9, 11, 23, 26, 32, 43 and 46 of the resonators 8, 10, 22, 25, 31, 42 and 45 are formed in a rectilinear shape, those linear conductors may be formed in a curved shape or a bent shape.

It is needless to say that the above-described embodiments are merely illustrative, and that the configurations in the different embodiments can be partly replaced or combined with each other.

The following examples are conceivable as forms of the band pass filter, the communication device, and the resonator that are included in the above-described embodiments.

A first form resides in a band pass filter including a dielectric substrate, ground conductors disposed respectively on a first surface and a second surface of the dielectric substrate, a first resonator including a linear conductor disposed inside the dielectric substrate, a second resonator including a linear conductor disposed inside the dielectric substrate, and a first input-output line and a second input-output line which connect the first resonator and the second resonator to external circuits and to which the first resonator and the second resonator are connected in parallel, wherein both ends of the linear conductor of the first resonator are left open, the second resonator includes a pair of first vias respectively through which both ends of the linear conductor of the second resonator are connected to the ground conductor on one of the first surface and the second surface of the dielectric substrate, the first input-output line includes one second via for connection to the ground conductor that is disposed on the other of the first surface and the second surface of the dielectric substrate and that is different from the ground conductor for connection through the first vias, and the second input-output line includes the other second via for connection to the ground conductor that is disposed on the other of the first surface and the second surface of the dielectric substrate and that is different from the ground conductor for connection through the first vias.

With the above-described feature, the first resonator operates as an odd mode resonator of which both ends are left open, and the second resonator operates as an even mode resonator of which both ends are connected to the ground conductor. The odd mode resonator and the even mode resonator are connected in parallel between the first input-output line and the second input-output line, thus constituting a resonator parallel-coupled filter. Furthermore, the first vias for the even mode resonator and the second vias for the input-output lines extend in the opposite directions with respect to a thickness direction of the dielectric substrate and are connected to the different ground conductors. As a result, the external Q of the even mode resonator is reduced and the fractional band width of the band pass filter can be widened in comparison with the case in which the first vias for the even mode resonator and the second vias for the input-output lines are connected to the same ground conductor.

According to a second form, the band pass filter according to the first form further includes a third resonator including a linear conductor disposed inside the dielectric substrate, the third resonator being coupled to the second resonator, and the third resonator includes a pair of third vias respectively through which both ends of the linear conductor of the third resonator are connected to the ground conductor that is disposed on the other of the first surface and the second surface of the dielectric substrate and that is different from the ground conductor for connection through the first vias. With that feature, the so-called Cul-de-Sac coupled filter can be constituted.

According to a third form, the band pass filter according to the first or second form further includes a penetration via that is positioned between the first resonator and the second resonator, that penetrates through the dielectric substrate in a thickness direction, and that connects the ground conductor on the first surface of the dielectric substrate and the ground conductor on the second surface of the dielectric substrate to each other. With that feature, it is possible to suppress unwanted resonance in the entirety of a package including the band pass filter. In addition, the coupling characteristics between the two resonators and the input-output lines can be stabilized.

According to a fourth form, in any one of the first to third forms, the linear conductor of the second resonator overlaps with the first input-output line and the second input-output line in the thickness direction of the dielectric substrate with an insulating layer interposed therebetween. With that feature, the external Q of the even mode resonator is reduced, and the fractional band width of the band pass filter can be widened.

According to a fifth form, in the fourth form, the linear conductor of the second resonator directly overlaps with the first input-output line and the second input-output line with any other electrode, conductor, or line not interposed therebetween.

According to a sixth form, in the fourth form, the linear conductor of the second resonator indirectly overlaps with the first input-output line and the second input-output line with another electrode, conductor, or line interposed therebetween.

A seventh form resides in a band pass filter including a dielectric substrate, ground conductors disposed respectively on a first surface and a second surface of the dielectric substrate, a first resonator including a linear conductor disposed inside the dielectric substrate, and a second resonator including a linear conductor disposed inside the dielectric substrate, the second resonator being coupled to the first resonator, wherein the first resonator includes a pair of first-surface side vias respectively through which both ends of the linear conductor of the first resonator are connected to the ground conductor that is disposed on the first surface of the dielectric substrate, and the second resonator includes a pair of second-surface side vias respectively through which both ends of the linear conductor of the second resonator are connected to the ground conductor that is disposed on the second surface of the dielectric substrate.

With the above-described feature, each of the first resonator and the second resonator operates as an even mode resonator of which both ends are connected to the ground conductor. Furthermore, the first-surface side vias for the first resonator operating as the even mode resonator and the second-surface side vias for the second resonator operating as the even mode resonator extend in the opposite directions with respect to the thickness direction of the dielectric substrate and are connected to the different ground conductors. As a result, the coupling coefficient between the two even mode resonators is increased and the fractional band width can be widened in comparison with the case in which the vias for the two even mode resonators are connected to the same ground conductor.

An eighth form resides in a band pass filter including a dielectric substrate, ground conductors disposed respectively on a first surface and a second surface of the dielectric substrate, a first resonator including a linear conductor disposed inside the dielectric substrate, and a second resonator including a linear conductor disposed inside the dielectric substrate, the second resonator being coupled to the first resonator, wherein the first resonator includes one first-surface side via through which a first end of the linear conductor of the first resonator is connected to the ground conductor that is disposed on the first surface of the dielectric substrate, and one second-surface side via through which a second end of the linear conductor of the first resonator is connected to the ground conductor that is disposed on the second surface of the dielectric substrate, and the second resonator includes the other second-surface side via through which a first end of the linear conductor of the second resonator is connected to the ground conductor that is disposed on the second surface of the dielectric substrate, and the other first-surface side via through which a second end of the linear conductor of the second resonator is connected to the ground conductor that is disposed on the first surface of the dielectric substrate.

According to a ninth form, the band pass filter according to the seventh or eighth form further includes a first input-output line and a second input-output line which connect the first resonator and the second resonator to external circuits and to which the first resonator and the second resonator are connected in series. With that feature, the first resonator and the second resonator are connected in series between the first input-output line and the second input-output line, whereby a resonator cascade-connected filter can be constituted.

According to a tenth form, in the ninth form, the first input-output line is connected through one line-side via to the ground conductor disposed on the second surface of the dielectric substrate and is coupled to the linear conductor of the first resonator, and the second input-output line is connected through the other line-side via to the ground conductor disposed on the first surface of the dielectric substrate and is coupled to the linear conductor of the second resonator.

In addition, the first-surface side via for one of the resonators and the one line-side via for one of the input-output lines extend in the opposite directions with respect to the thickness direction of the dielectric substrate and are connected to the different ground conductors. Similarly, the second-surface side via for the other resonator and the other line-side via for the other input-output line extend in the opposite directions with respect to the thickness direction of the dielectric substrate and are connected to the different ground conductors. As a result, the external Q of each of the resonators is reduced and the fractional band width of the band pass filter can be widened in comparison with the case in which the via for the resonator (the even mode resonator) and the via for the input-output line are connected to the same ground conductor.

According to an eleventh form, in the ninth form, one of the pair of input-output lines is directly connected to the linear conductor of the one resonator, and another input-output line is directly connected to the linear conductor of the other resonator. With that feature, the pair of input-output lines can be directly coupled respectively to the two resonators.

A communication device according to a twelfth form includes the band pass filter according to any one of the above-mentioned forms 1 to 11.

A thirteenth form resides in a resonator including a dielectric substrate, ground conductors disposed respectively on a first surface and a second surface of the dielectric substrate, and a first input-output line and a second input-output line each disposed in or on the dielectric substrate, wherein the resonator includes a linear conductor disposed inside the dielectric substrate and a pair of first vias respectively through which both ends of the linear conductor are connected to the ground conductor that is disposed on one of the first surface and the second surface of the dielectric substrate, the first input-output line includes one second via for connection to the ground conductor that is disposed on the other of the first surface and the second surface of the dielectric substrate and that is different from the ground conductor for connection through the first vias, and the second input-output line includes the other second via for connection to the ground conductor that is disposed on the other of the first surface and the second surface of the dielectric substrate and that is different from the ground conductor for connection through the first vias.

1, 16, 21, 41, 51, 54 band pass filter
2 dielectric substrate
2A first surface
2B second surface
6, 7 ground conductor
8, 22, 42 resonator (first resonator)
10, 25, 45 resonator (second resonator)
9, 11, 23, 26, 32, 43, 46 linear conductor
9A, 11A, 23A, 26A, 32A, 43A, 46A first end
9B, 11B, 23B, 26B, 32B, 43B, 46B second end
12A, 12B, 27A, 27B via (first via)
13, 28, 48, 52 input-output line (first input-output line)
14, 29, 49, 53 input-output line (second input-output line)
15A, 15B, 30A, 30B via (second via) resonator (third resonator)
33A, 33B via (third via)
17, 34 penetration via
44A, 44B via (first-surface side via)
47A, 47B via (second-surface side via)
50A, 50B via (line-side via)
55A via (first-surface side via)
55B via (second-surface side via)
56A via (other second-surface side via)
56B via (other first-surface side via)
61 communication device
63B, 63C band pass filter

The invention claimed is:

1. A band pass filter comprising:
a dielectric substrate;
ground conductors disposed respectively on a first surface and a second surface of the dielectric substrate;
a first resonator including a first linear conductor disposed inside the dielectric substrate;
a second resonator including a second linear conductor disposed inside the dielectric substrate; and
a first input-output line and a second input-output line connecting the first resonator and the second resonator to external circuits, wherein the first resonator and the second resonator are connected in parallel between the first input-output line and the second input-output line,
wherein both ends of the first linear conductor are left open,
the second resonator includes a pair of first vias respectively through which both ends of the second linear conductor are connected to one of the ground conductors disposed on one of the first surface and the second surface of the dielectric substrate,
the first input-output line includes one second via connected to the other of the ground conductors disposed on the other of the first surface and the second surface of the dielectric substrate and different from the one of the ground conductors connected through the first vias, and
the second input-output line includes the other second via connected to the other of the ground conductors disposed on the other of the first surface and the second surface of the dielectric substrate and different from the one of the ground conductors connected through the first vias.

2. The band pass filter according to claim 1, further comprising:
a third resonator including a third linear conductor disposed inside the dielectric substrate, the third resonator being coupled to the second resonator, and
the third resonator includes a pair of third vias respectively through which both ends of the third linear conductor are connected to the other of the ground conductors disposed on the other of the first surface and the second surface of the dielectric substrate and different from the one of the ground conductors connected through the first vias.

3. The band pass filter according to claim 1, further comprising a penetration via positioned between the first resonator and the second resonator, penetrating through the dielectric substrate in a thickness direction, and connecting one of the ground conductors on the first surface of the dielectric substrate to another one of the ground conductors on the second surface of the dielectric substrate.

4. The band pass filter according to claim 1, wherein the second linear conductor overlaps with the first input-output line and the second input-output line in the thickness direction of the dielectric substrate with an insulating layer interposed therebetween.

5. The band pass filter according to claim 4, wherein the second linear conductor directly overlaps with the first input-output line and the second input-output line with any other electrode, conductor, or line not interposed therebetween.

6. The band pass filter according to claim 4, wherein the second linear conductor indirectly overlaps with the first input-output line and the second input-output line with another electrode, conductor, or line interposed therebetween.

7. A band pass filter comprising:

a dielectric substrate;

ground conductors disposed respectively on a first surface and a second surface of the dielectric substrate;

a first resonator including a first linear conductor disposed inside the dielectric substrate; and a second resonator including a second linear conductor disposed inside the dielectric substrate, the second resonator being coupled to the first resonator, wherein the first resonator includes a pair of first-surface side vias respectively through which both ends of the first linear conductor are connected to one of the ground conductors disposed on the first surface of the dielectric substrate, and the second resonator includes a pair of second-surface side vias respectively through which both ends of the second linear conductor are connected to the other of the ground conductors disposed on the second surface of the dielectric substrate.

8. A band pass filter comprising:

a dielectric substrate;

ground conductors disposed respectively on a first surface and a second surface of the dielectric substrate;

a first resonator including a first linear conductor disposed inside the dielectric substrate; and a second resonator including a second linear conductor disposed inside the dielectric substrate, the second resonator being coupled to the first resonator, wherein the first resonator includes one first-surface side via through which a first end of the first linear conductor is connected to one of the ground conductors disposed on the first surface of the dielectric substrate, and one second-surface side via through which a second end of the first linear conductor is connected to the other of the ground conductors disposed on the second surface of the dielectric substrate, and the second resonator includes the other second-surface side via through which a first end of the second linear conductor is connected to the other of the ground conductors disposed on the second surface of the dielectric substrate, and the other first-surface side via through which a second end of the second linear conductor is connected to the one of the ground conductors disposed on the first surface of the dielectric substrate.

9. The band pass filter according to claim 7, further comprising a first input-output line and a second input-output line connecting the first resonator and the second resonator to external circuits, wherein the first resonator and the second resonator are connected in series between the first input-output line and the second input-output line.

10. The band pass filter according to claim 9, wherein the first input-output line is connected through one line-side via to the other of the ground conductors disposed on the second surface of the dielectric substrate and is coupled to the first linear conductor, and the second input-output line is connected through the other line-side via to the one of the ground conductors disposed on the first surface of the dielectric substrate and is coupled to the second linear conductor.

11. The band pass filter according to claim 9, wherein the first input-output line is directly connected to the linear conductor of the first resonator, and the second input-output line is directly connected to the linear conductor of the second resonator.

12. A communication device including the band pass filter according to claim 1.

13. The band pass filter according to claim 2, further comprising a penetration via positioned between the first resonator and the second resonator, penetrating through the dielectric substrate in a thickness direction, and connecting one of the ground conductors on the first surface of the dielectric substrate to another one of the ground conductors on the second surface of the dielectric substrate.

14. The band pass filter according to claim 2, wherein the second linear conductor overlaps with the first input-output line and the second input-output line in the thickness direction of the dielectric substrate with an insulating layer interposed therebetween.

15. The band pass filter according to claim 3, wherein the second linear conductor overlaps with the first input-output line and the second input-output line in the thickness direction of the dielectric substrate with an insulating layer interposed therebetween.

16. The band pass filter according to claim 8, further comprising a first input-output line and a second input-output line connecting the first resonator and the second resonator to external circuits, wherein the first resonator and the second resonator are connected in series between the first input-output line and the second input-output line.

17. A communication device including the band pass filter according to claim 2.

18. A communication device including the band pass filter according to claim 3.

19. A communication device including the band pass filter according to claim 4.

* * * * *